US006171747B1

(12) United States Patent
Sugizaki et al.

(10) Patent No.: US 6,171,747 B1
(45) Date of Patent: Jan. 9, 2001

(54) IMAGE FORMING METHOD

(75) Inventors: Yutaka Sugizaki; Hirokazu Hamano, both of Minamiashigara (JP)

(73) Assignee: Fuji Xerox Co., Ltd., Tokyo (JP)

( * ) Notice: Under 35 U.S.C. 154(b), the term of this patent shall be extended for 0 days.

(21) Appl. No.: 09/386,368

(22) Filed: Aug. 31, 1999

(30) Foreign Application Priority Data

Oct. 6, 1998 (JP) ..... 10-284616

(51) Int. Cl.[7] ..... G03G 13/16
(52) U.S. Cl. ..... 430/126; 430/45
(58) Field of Search ..... 430/45, 106, 109, 430/126

(56) References Cited

U.S. PATENT DOCUMENTS 5,733,692 * 3/1998 Nagase et al. ..... 430/45
5,981,121 * 11/1999 Ide ..... 430/45

FOREIGN PATENT DOCUMENTS 57-79958 5/1982 (JP) .
4-242752 8/1992 (JP) .

* cited by examiner

*Primary Examiner*—John Goodrow
(74) *Attorney, Agent, or Firm*—Oliff & Berridge, PLC

(57) ABSTRACT

Provided is an image forming method including at least a latent image-forming step of forming an electrostatic latent image on a latent image support, a developer layer-forming step of forming a developer layer on a surface of a developer support disposed opposite the latent image support, a developing step of developing the electrostatic latent image on the latent image support with the toner in the developer layer to form a toner image, and a transferring step of transferring the toner image onto a transfer material, characterized in that the latent image support is obtained by forming at least an organic photoconductive layer on a surface of an electroconductive support, the toner is composed of color particles containing at least a binder resin and a coloring agent, a volume average particle diameter of the color particles is between 2.0 and 5.0 $\mu$m, the ratio of the color particles of 1.0 $\mu$m or less is 20% or less in terms of the number of distribution, and the ratio of the color particles exceeding 5.0 $\mu$m is 10% or less in terms of the number of distribution, and the coloring agent is pigment particles.

The invention provides the image forming method which can give an image excellent in the fine line reproducibility and the gradation without the disorder of the image and which can suppress deterioration of the latent image support owing to damage or wearing-out of the surface of the latent image support having the organic photoconductive layer.

18 Claims, 2 Drawing Sheets

IMAGE FORMING METHOD

BACKGROUND OF THE INVENTION

1. Field of the Invention

The present invention relates to an image forming method which is applied to an electrophotographic method, an electrostatic recording method and an electrostatic printing method. Specifically, the invention relates to an image-forming method for obtaining an image from a digital electrostatic latent image.

2. Description of Related Art

In the electrophotographic method, a toner in a developer is adhered to an electrostatic latent image formed on a latent image support (hereinafter sometimes referred to as a "photoreceptor"), transferred onto a paper or a plastic film as a transfer material, and fixed through heating to form an image.

Coloration has been progressed in a printer or a copier using an electrophotographic method. Further, a latent image is rendered fine to improve resolution of the apparatus. Accordingly, in a full-color copier in which a digital latent image is developed, transferred and fixed using a color toner, a toner having a small particle diameter of from 7 to 8 $\mu$m is employed to achieve an image of a high quality to some extent. However, the further improvement of a fine line reproducibility or a gradation has been required by more reducing the particle diameter of the toner.

Meanwhile, as a photoreceptor used in the electrophotographic method, an inorganic photoreceptor has been so far used. However, in recent years, the studies and the development of an organic photoreceptor (OPC) which has an organic photoconductive layer on the surface and which is less costly and excellent in a productivity and a disposal. Among others, a so-called functionally separate laminated photoreceptor obtained by laminating a charge generation layer and a charge transfer layer has been put to practical use.

It is deemed that the life of the organic photoreceptor ends mainly when the image defect owing to the staining of the surface and the image defect owing to the wearing-out of the surface layer occur. Therefore, an organic photoreceptor of which the surface is less stained and less worn out has been in demand for prolonging the life thereof.

It is indeed unavoidable that the surface of the organic photoreceptor is stained with a toner and an external additive to some extent. Ordinarily, the staining is prevented by appropriately wearing out the surface of the organic photoreceptor with an external additive. As the hardness of a toner or an external additive is increased and the particle diameter thereof is increased, the wearing-out of the surface of the organic photoreceptor tends to be increased. Accordingly, in order to prevent the surface of the organic photoreceptor from being stained, an external additive having an appropriate hardness and an appropriate size is generally used.

At this time, when an amount of a toner consumed is increased, an amount of a toner that is passed in contact with the organic photoreceptor is increased, and an amount of an external agent fed to the organic photoreceptor is also increased naturally to accelerate the staining and the wearing-out of the surface of the organic photoreceptor. Further, when the particle diameter of the toner is decreased, the amount of the external additive is sometimes increased for improving a fluidity, accelerating the staining and the wearing-out of the external additive.

Consequently, it is required that the amount of the toner consumed and the amount of the external additive are decreased to prevent the properties of the photoreceptor from being worsened.

The organic photoreceptor has the non-uniformity of the surface to some extent for reasons of the production, and the electrostatic latent image formed on the surface is thereby influenced, with the result that the unclear image is naturally formed. This unclear electrostatic latent image is a defect in the digital electrophotographic method.

In a development nip portion in which the development is conducted, a toner is flown and reversely flown repetitively between an organic photoreceptor and a developer support by an action of a development electric field. When the development electric field is not activated immediately after passage through the development nip portion, the image structure of the electrophotographic latent image formed on the surface of the organic photoreceptor is determined. When the electrostatic latent image is unclear, the sharpness is worsened immediately after passage through the development nip portion to cause the disorder of the image. Especially, it is considered that a toner having a large particle diameter has a relatively low non-electrostatic adhesion and tends to entrain the action of the development electric field, decreasing the sharpness and causing the disorder of the image. Meanwhile, when the particle diameter is decreased, the non-electrostatic adhesion is increased, and it becomes hard to fly the toner from the carrier to the photoreceptor.

On the other hand, in a transferring step of transferring the toner image developed onto a transfer material, the toner is flown from the organic photoreceptor to the transfer material by the action of the transfer electric field in the transfer nip portion. However, a toner having a large amount of charge tends to be scattered, causing the disorder of the image. It is considered that since a toner having a large particle diameter has a relatively low adhesion, it also tends to entrain the action of the transfer electric field, causing the disorder of the image. Meanwhile, when the particle diameter of the toner is small, it becomes hard to transfer the image from the photoreceptor, decreasing the transferring property.

Consequently, in the image-forming method using the organic photoreceptor, a toner of a small particle diameter which can appropriately control the non-electrostatic adhesion and the charge amount of the toner and which does not cause the disorder of the image has been in demand.

SUMMARY OF THE INVENTION

It is an object of the invention to provide an image-forming method by which an image excellent in a fine line reproducibility and a gradation is obtained and deterioration of a latent image support having an organic photoconductive layer owing to damage or wearing-out of the surface of the latent image support can be suppressed.

Another object of the invention is to provide an image-forming method which does not cause the disorder of the image though using the latent image support having the organic photoconductive layer.

Figure 1:
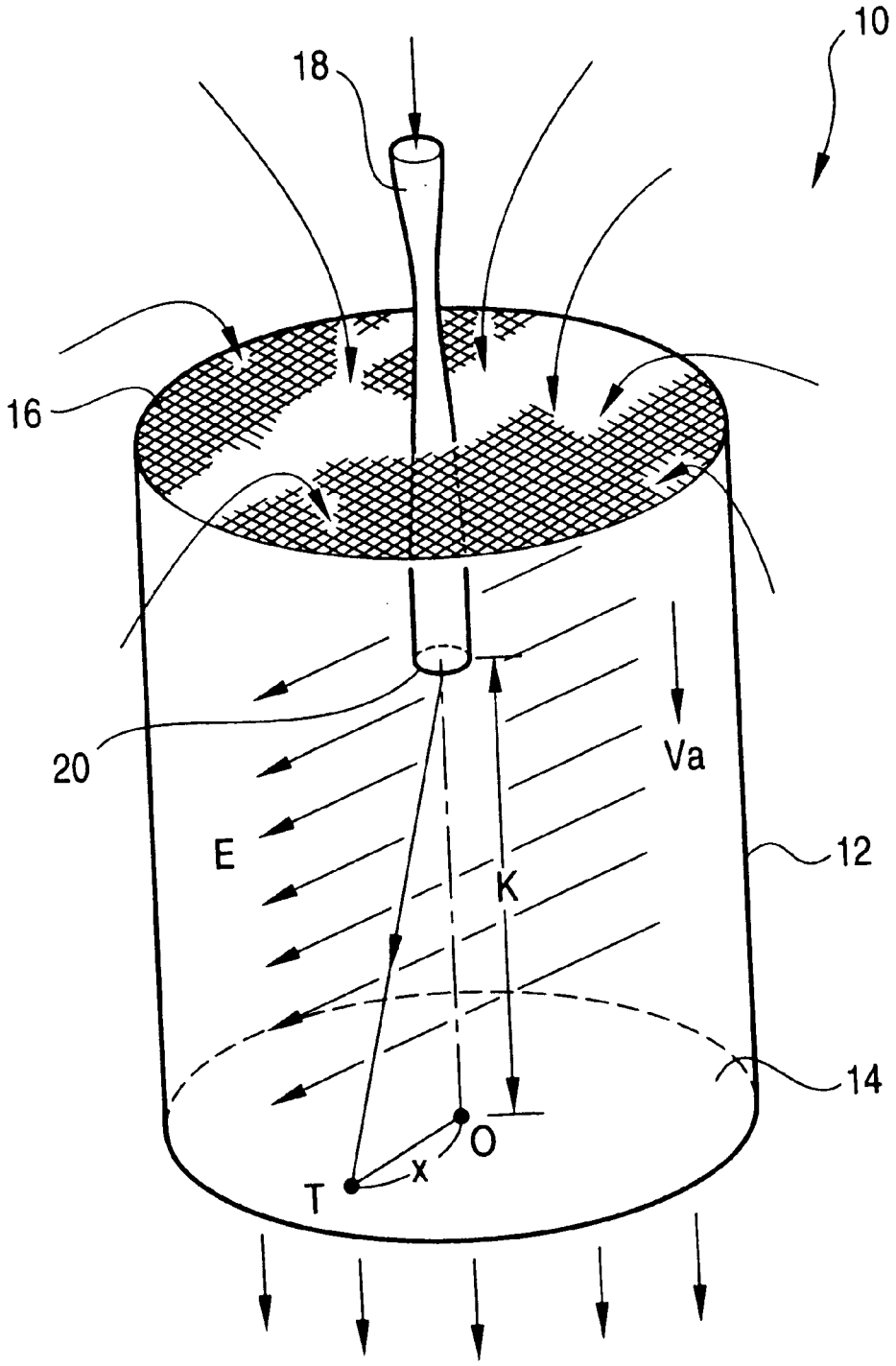
FIG. 1 is a simplified perspective view of a measuring apparatus for measuring a frequency distribution of a q/d value by charge spectrography (hereinafter referred to as "CSG").

In the drawings, 10 is a measuring apparatus, 12 a drum, 14 a filter, 16 a mesh, 18 a sample supply cylinder, 20 a sample outlet, 22 and 22*a* to 22*f* external additives, 30 a photoreceptor (latent image support), 31 a charge roll, 32 a laser exposure optical system, 33 a developing unit, 33*a* a developer support, 34 a transfer roll, 35 a static eliminator, 36 a cleaning blade, 37 and 38 fixing rolls, and 40 a sheet.

DETAILED DESCRIPTION OF THE INVENTION

The invention is to provide an image-forming method comprising at least a latent image-forming step of forming an electrostatic latent image on a latent image support, a developer layer-forming step of forming a developer layer comprising a toner and a carrier on a surface of a developer support disposed opposite the latent image support, a developing step of developing the electrostatic latent image on the latent image support with the toner in the developer layer to form a toner image, and a transferring step of transferring the toner image developed onto a transfer material, characterized in that the latent image support is obtained by forming at least an organic photoconductive layer on a surface of an electroconductive support, the toner is composed of color particles (which are a portion excluding an external additive in the toner, namely which are generally called toner particles) containing at least a binder resin and a coloring agent, (a) a volume average particle diameter of the color particles is between 2.0 and 5.0 $\mu$m, the ratio of the color particles of 1.0 $\mu$m or less is 20% or less in terms of the number of distribution, and the ratio of the color particles exceeding 5.0 $\mu$m is 10% or less in terms of the number of distribution, and (d) the coloring agent is pigment particles.

In the invention in which the particle size distribution of the color particles is defined as mentioned above, it is possible that the fine line reproducibility and the gradation of the image obtained are achieved, that the amount of the toner of the toner image to be formed on the organic photoreceptor as the latent image support is decreased, and that the staining or the wearing-out of the organic photoreceptor is suppressed. Further, the invention in which the particle size distribution of the color particles is defined as mentioned above makes it possible to easily obtain a toner having a charge amount distribution which is appropriate for removing a factor to inhibit a stability of a toner with time such as agglomeration of toner particles or which is appropriate for preventing the disorder of the image caused by an unclear electrostatic latent image formed on a surface of an organic photoreceptor. Still further, in the invention in which the particle size distribution of the color particles, the non-electrostatic adhesion between the toner and the latent image support is appropriately controlled, improving the sharpness of the image and less causing the disorder of the image.

It is required that the amount, per unit weight of the color particles, of the external additive which is added to improve the stability with time of the toner is increased to some extent with the increasing surface area. However, in the invention in which the particle size distribution of the color particles is appropriately defined as mentioned above, the amount of the toner of the toner image to be formed on the organic photoreceptor can be decreased, with the result that the amount of the external additive can also be decreased as a whole. Consequently, the staining or the wearing-out of the organic photoreceptor can be suppressed.

In order to more increase these effects, it is preferable that in the particle size distribution of the color particles, the ratio of the color particles of from 1.0 to 2.5 $\mu$m is between 5.0 and 50% in terms of the number of distribution.

In the charge amount distribution of the toner, it is actually appropriate, for preventing the disorder of the image caused by the unclear electrostatic latent image formed on the surface of the organic photoreceptor, that when the charge amount of the toner in such an atmosphere that the temperature of the toner is 20° C. and the humidity thereof is 50% is represented by q(fC) and the particle diameter of the toner is represented by d ($\mu$m), the peak value is 1.0 or less and the bottom value is 0.005 or more in the frequency distribution of the q/d value. The above-mentioned appropriate charge amount distribution of the toner further provides the following effects.

The flying and the reverse flying of the toner occur in the development nip portion during the developing step by the action of the development electric field. When the q/d value is decreased as mentioned above, the flying of the toner less occurs as the development electric field becomes weak immediately after passage through the development nip portion. Meanwhile, when the particle size distribution of the toner is appropriately adjusted, the non-electrostatic adhesion between the toner and the organic photoreceptor is appropriately controlled, and the reverse flying of the toner once adhered to the organic photoreceptor less occurs as the development electric field becomes weak immediately after passage through the development nip portion. Accordingly, it is presumed that in the image passed through the development nip portion, especially, in the edge portion thereof, the flying of the toner is immediately finished soon after the development electric field becomes weak, with the result that the sharpness of the image is good and the disorder of the image less occurs.

Further, it is presumed that in the transferring step also, the q/d value and the particle size distribution of the toner are appropriately adjusted, so that the flying of the toner is effectively prevented in the image passed through the transfer nip portion, especially in the edge portion thereof and the disorder of the image less occurs.

On the other side, it is preferable that the amount of the toner of the toner image formed on the latent image support is actually 0.50 mg/cm$^2$ or less. When the amount of the toner per unit area of the latent image support is thus controlled, it is possible to control the amount of the toner consumed, to suppress the staining or the wearing-out of the organic photoreceptor and to reduce the thickness of the image. Accordingly, the image which is excellent in the fine line reproducibility and the gradation can be formed without disturbing the layer of the toner in transferring the image onto the transfer material in the transferring step.

In the invention, it is preferable, for improving the coloring power and the transparency of the toner, that the dispersed particle average diameter of the pigment particles of the color particles is 0.3 $\mu$m or less in terms of the corresponding circle diameter.

It is advisable that an external additive is added to the toner for maintaining a high handleability and improving a stability with time. Further, it is advisable that the external additive to be added comprises at least one or more types of superfine particles having a primary particle average diameter of at least 30 nm and at most 200 nm and one or more type of hyperfine particles having a primary particle average diameter of at least 5 nm and less than 30 nm, the coating rate of the external additive to the surfaces of the color particles as obtained by formula (1)

$$F=\sqrt{3}\cdot D\cdot\rho_t\cdot(2\pi\cdot d\cdot\rho_a)^{-1}\cdot C\times 100 \quad (1)$$

wherein F represents a coating rate (%), D represents a volume average particle diameter ($\mu$m) of color particles, $\rho_t$ represents a true specific gravity of color particles, d represents a primary particle average diameter ($\mu$m) of an external additive, $\rho_a$ represents a true specific gravity of an external additive, and C represents a ratio (x/y) of an amount x(g) of an external additive to an amount y(g) of color particles is 20% or more on both of the superfine particles Fa and the hyperfine particles Fb, and the total coating rate of the overall external additive is 100% or less.

In the invention, in order to provide the satisfactory coloring power of the toner and obtain a high image density, it is preferable that when a pigment concentration of pigment particles in the color particles is represented by C (% by weight), a true specific gravity of color particles is represented by a (g/cm$^3$) and a volume average particle diameter of the color particles is represented by D ($\mu$m), the following relationship (2) is satisfied.

$$25\leqq a\cdot D\cdot C\leqq 90 \quad (2)$$

This organic photoconductive layer has preferably a laminated structure formed of a charge generation layer composed of at least a charge generation material and a binder resin, and a charge transfer layer composed of at least a charge transfer material and a binder resin.

As the binder resin used in the organic photoconductive layer, a polycarbonate resin having a viscosity average molecular weight of from 50,000 to 100,000 is preferable.

Further, a weight ratio (s:t) of the charge transfer material s and the binder resin t in the charge transfer layer is preferably between 25:75 and 60:40.

Still further, in order to completely protect the latent image support from the adhesion of the external additive and markedly improve the durability, it is preferable that a surface coating layer is further formed on the surface of the organic photoconductive layer. In order to maintain the performance of the latent image support for a long period of time, it is preferable that the thickness of the organic photoconductive layer is 5 $\mu$m or more.

The image-forming method of the invention is described in detail below.

[Latent image-forming step]

In the invention, the latent image-forming step is a step of forming an electrostatic latent image on a latent image support.

An electrostatic latent image is formed by conducting image exposure on a surface of a latent image support through an exposure means such as a laser optical system or an LED array, and a known means and a known method can be applied thereto.

As the latent image support in the invention, an organic photoreceptor (OPC) that takes a form of a rotary drum, a sheet or a plate and that has at least an organic photoconductive layer issued. The organic photoreceptor is less costly and excellent in the productivity and the disposal.

In the invention, it is required to solve the problems associated with the adhesion of the external additive, namely, the unsatisfactory cleaning, the defect of the image and the damage of the surface of the latent image support. In the invention, a toner capable of reducing the amount of the toner fed to the latent image support is used. Further, the organic photoreceptor (OPC) is used as the latent image support to effectively remove the external additive adhered to the organic photoconductive layer in the cleaning step.

That is, in the latent image support having a relatively low surface hardness, such as the organic photoreceptor, even when the external additive is adhered to the surface thereof, the organic photoconductive layer is worn out to some extent with the cleaning blade and the external additive, whereby the external additive adhered thereto is removed at the same time without being accumulated, making it possible to prevent the formation of the defective image for a long period of time.

In addition, a surface coating layer can also be formed on the surface of the organic photoconductive layer, adjusting the degree of the surface wearing-out to a preferable range with this surface coating layer. Further, the external additive is less adhered to the surface coating layer, making it possible to completely prevent the adhesion of the external additive and to completely protect the organic photoconductive layer from the external additive, other oxidative gases and a moisture. Accordingly, this is especially preferable.

The structure of the organic photoreceptor is described in detail below.

<Structure of the organic photoreceptor (OPC)>

The organic photoreceptor preferably used in the invention has at least an organic photoconductive layer on a surface of an electroconductive support.

1. Electroconductive support

In the invention, any material used so far as an electroconductive support of an electrophotographic photoreceptor can be used as the electroconductive support. Further, an opaque or substantially transparent material can be used. Examples thereof include metals such as aluminum, nickel, chromium and stainless steel; a plastic film, a glass and ceramics having a thin film of aluminum, titanium, zirconium, nickel, chromium, stainless steel, gold, platinum, silveroxide, indium oxide or ITO; and a paper, a plastic film, a glass and ceramics coated or dipped with an electroconductive agent. The form of the electroconductive support can appropriately be selected from a drum, a sheet and a plate according to the use purpose.

Further, the surface of the electroconductive support can be subjected to various treatments as required unless the quality of the image is thereby influenced. Examples of the treatments include surface-roughening treatments such as surface oxidation treatment (anode oxidation treatment), chemical treatment, liquid horning and graining, other chemical treatments and coloration treatment. The oxidation treatment and the surface-roughening treatments of the surface of the electroconductive support roughen not only the surface of the electroconductive support but also the surface of the layer coated thereon, making it possible to exhibit the effect of preventing the occurrence of interference fringe by the regular reflection on the surface of the electroconductive support and/or the interface of the laminated film which is caused when using a coherent light source such as a laser as an exposure light source.

An undercoat layer may be formed between the electroconductive support and the organic photoconductive layer as required. The undercoat layer is effective for inhibiting injection of an unnecessary charge from the electroconductive support, and acts to improve the chargeability of the organic photoreceptor. Further, it also acts to improve the adhesion between the organic photoconductive layer and the electroconductive support.

As the binder resin used in the undercoat layer, a known material is available. Examples thereof include a polyethylene resin, a polypropylene resin, an acrylic resin, a methacrylic resin, a polyamide resin, a vinyl chloride resin, a vinyl acetate resin, a phenolic resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, a polyglutamic acid, starch, starch acetate, amino starch, polyacrylic acid, polyacrylamide, a zirconium chelate compound, a titanium chelate compound, a titanium alkoxide compound, an organic titanyl compound and a silane coupling agent. These can be used either singly or in combination.

This undercoat layer can contain fine particles of titanium oxide, silicon oxide, zirconium oxide, barium titanate and a silicon resin.

The dry film thickness of the undercoat layer is appropriately between 0.01 and 10 $\mu$m, preferably between 0.05 and 2 $\mu$m.

The undercoat layer can be coated by an ordinary method, such as a blade coating method, a wire bar coating method, a spray coating method, a dip coating method, a bead coating method, an air knife coating method or a curtain coating method.

2. Organic photoconductive layer

In the invention, as a structure of the organic photoconductive layer, a laminated structure formed of a charge generation layer composed of at least a charge generation material and a binder resin and a charge transfer layer composed of at least a charge transfer material and a binder resin is mentioned. However, this structure is not critical, and an organic photoconductive layer of a single layer structure is also available.

Further, especially when a surface coating layer to be described layer is absent, in consideration of a durability, the thickness of the organic photoconductive layer has to be increased to some extent for keeping a clean surface state by appropriately wearing out the organic photoconductive layer itself in removing the external agent adhered to the organic photoconductive layer with a cleaning blade in the cleaning step. It is preferably 5 $\mu$m or more. When it is less than 5 $\mu$m, a satisfactory durability is hardly obtained owing to the wearing-out. The thickness of the organic photoconductive layer is more preferably 10 $\mu$m or more. Meanwhile, in view of the production adaptability, the thickness of the organic photoconductive layer is preferably 2,000 $\mu$m or less, more preferably less than 1,000 $\mu$m, further preferably less than 500 $\mu$m.

The specific structure of the organic photoconductive layer is described below.

The organic photoconductive layer of the laminated structure is formed of the charge transfer layer and the charge generation layer. With respect to the lamination order of the charge transfer layer and the charge generation layer, either of these layers may be an upper layer. Further, each thereof may have a laminated structure.

The charge generation layer in the organic photoconductive layer of the laminated structure is composed of at least the charge generation material and the binder resin.

Examples of the charge generation material include inorganic photoconductive materials such as amorphous selenium, a crystalline selenium-tellurium alloy, a selenium-arsenic alloy, other selenium compounds and selenium alloys, zinc oxide and titanium oxide; and organic pigments or dyes such as a phthalocyanine compound, a squarium compound, an anthoanthrone compound, a perylene compound, an azo compound, an anthraquinone compound, a pyrene compound, a pyrylium compound and a thiapyrylium compound. Of these, the phthalocyanine compound is preferable because of the high light sensitivity. Specifically, metal-free phthalocyanine, oxytitanium phthalocyanine, halogenated gallium phthalocyanine, hydroxygallium phthalocyanine and halogenated tin phthalocyanine are preferable.

Chlorogallium phthalocyanine with a specific crystal form having strong diffraction peaks at 7.4°, 16.6°, 25.5° and 28.3° of the Bragg angle (2q±0.2°) in the X-ray diffraction spectrum, or hydroxygallium phthalocyanine with a specific crystal form having strong diffraction peaks at 7.5°, 9.9°, 12.5°, 16.3°, 18.6°, 25.1° and 28.3° of the Bragg angle (2q±0.2°) in the X-ray diffraction spectrum is especially preferable because of a high charge generation efficiency to a wide range of light from visible light to near infrared light.

Examples of the binder resin of the charge generation layer include a polyvinyl butyral resin, a polyvinyl formal resin, a partially modified polyvinyl acetal resin, a polycarbonate resin, a polyester resin, an acrylic resin, a polyvinyl chloride resin, a polystyrene resin, a polyvinyl acetate resin, a vinyl chloride-vinyl acetate copolymer, a silicone resin, a phenolic resin and a poly-N-vinylcarbazole resin.

These resins can be used either singly or in combination. As the binder resin of the charge generation layer, the preferable resins are mentioned above. However, these are not critical in the invention.

The mixing ratio (weight ratio) of the charge generation material to the binder resin is preferably between 10:1 and 1:10, more preferably between 10:2 and 2:10. The charge generation layer can be formed by dissolving or dispersing the charge generation material and the binder resin in an appropriate solvent to form a coating solution, coating this coating solution on the electroconductive support or the charge transfer layer formed on the electroconductive support as will be described later, and then heat-drying the same.

Examples of the solvent used in forming the coating solution include ordinary organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride and chloroform. These can be used either singly or in combination.

The coating can be conducted by an ordinary method such as a blade coating method, a wire bar coating method, a spray coating method, a dip coating method, a bead coating method, an air knife coating method or a curtain coating method. The dry film thickness of the charge generation layer is generally between 0.1 and 5 $\mu$m, preferably between 0.2 and 2.0 $\mu$m.

The charge transfer layer in the organic photoconductive layer of the laminated structure is formed of at least the charge transfer material and the binder resin. Incidentally, there is also a structure made only of a high-molecular charge transfer material. In this case, the high-molecular transfer material plays the parts of both the charge transfer material and the binder resin. In the invention, the term "the charge transfer material and the binder resin" has a concept also including the structure made only of the high-molecular charge transfer material.

Examples of the charge transfer material include electron attractive materials, for example, a quinone compound such as p-benzoquinone, chloranil, bromanil or anthraquinone, a tetracyanoquinodimethane compound, a fluorenone compound such as 2,4,7-trinitrofluorenone, a xanthone compound, a benzophenone compound, a cyanovinyl compound and an ethylene compound, a triphenylamine compound, a bendizine compound, an arylalkane compound, an aryl-substituted ethylene compound, a stilbene compound, an anthracene compound and a hydrazone compound. These charge transfer materials can be used either singly or in combination.

Examples of the binder resin of the charge transfer layer include known resins such as a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-acrylic resin, a styrene-alkyd resin, a poly-N-vinylcarbasole and polysilane.

Of these, apolycarbonate resin having a viscosity average molecular weight of from 50,000 to 100,000 is especially preferable in view of the wearability and the productivity of the photoconductive layer. The viscosity average molecular weight of the polycarbonate resin which is available as the binder resin of the charge transfer layer is more preferably between 55,000 and 95,000. When the viscosity average molecular weight is too low, the layer tends to be worn out. Meanwhile, when it is too high, the viscosity tends to be decreased.

On the other hand, as the high-molecular charge transfer material, known materials having a charge transferring property, such as poly-N-vinylcarbazole and polysilane can be used. For example, a polyester high-molecular charge transfer material described in U.S. Pat. No. 4,801,517 is preferable because of a high charge transferring property.

The charge transfer layer may contain an antioxidant for preventing deterioration by an oxidative gas generated from a charge device, such as ozone. Even though the surface coating layer to be described layer is present, the oxidative gas sometimes permeates the surface protective layer and enters into the charge transfer layer. In order to prevent the oxidative deterioration thereby caused, it is advisable to add an antioxidant.

As the antioxidant, a hindered phenol antioxidant or a hindered amine antioxidant is preferable. Known antioxidants such as an organic iodine antioxidant, a phosphite antioxidant, a dithiocarbamate antioxidant, a thiourea antioxidant and a benzimidazole antioxidant may be used.

The amount of the antioxidant is preferably 15% by weight or less, preferably 10% by weight or less based on the solid content of the charge transfer layer.

The mixing ratio (s:t weight ratio) of the charge transfer material s and the binder resin t is preferably between 10:90 and 70:30, more preferably between 25:75 and 60:40. The charge transfer layer can be formed by dissolving and dispersing the charge transfer material and the binder resin and as required, the antioxidant in an appropriate solvent to form a coating solution, coating the coating solution on the electroconductive support or the charge generation layer formed on the electroconductive support, and then heat-drying the same.

Examples of the solvent used in forming the coating solution include ordinary organic solvents, for example, aromatic hydrocarbons such as benzene, toluene, xylene and chlorobenzene; ketones such as acetone and 2-butanone; halogenated aliphatic hydrocarbons such as methylene chloride, chloroform and ethylene chloride; and cyclic or linear ethers such as tetrahydrofuran, ethyl ether and dioxane. These can be used either singly or in combination.

As the coating method of the charge transfer layer, the same known methods as mentioned in the charge generation layer can be employed. The dry film thickness of the charge transfer layer is between 5 and 50 $\mu$m, preferably between 10 and 40 $\mu$m.

3. Surface coating layer

In order to completely prevent the adhesion of the external additive to the latent image support, to completely protect the latent image support from an oxidative gas and a moisture and to markedly improve the durability, it is advisable that the surface coating layer is formed on the surface of the organic photoconductive layer. The surface coating layer includes an insulating resin protective layer and a low-resistance protective layer obtained by adding a resistance modifier to an insulating resin. In case of the low-resistance protective layer, for example, a layer obtained by dispersing electroconductive fine particles in an insulating resin is mentioned. The electroconductive fine particles are preferably white, gray or pale white fine particles having an electrical resistance of $10^9\Omega\cdot$cm or less and a number average particle diameter ($D_{50}$) of 0.3 $\mu$m or less, more preferably fine particles having a number average particle diameter of 0.1 $\mu$m or less. Examples thereof include molybdenum oxide, tungsten oxide, antimony oxide, tinoxide, titanium oxide, indiumoxide, a solid solution of tin oxide and antimony or antimony oxide, a mixture thereof, and products obtained by mixing or coating single particles with these metal oxides. Of these, tin oxide and the solid solution of tin oxide and antimony or antimony oxide are preferably used because the electrical resistance can appropriately be adjusted and the protective layer can substantially be rendered transparent (refer to JP-A-57-30847 and JP-A-57-128344).

Examples of the insulating resin include condensation resins such as a polyamide, a polyurethane, a polyester, an epoxy resin, a polyketone and a polycarbonate; and vinyl polymers such as polyvinyl ketone, polystyrene and polyacrylamide.

As the component of the surface coating layer, a compound having hydroxy groups, such as a glycol compound or a bisphenol compound is preferably used as required.

The compound having the hydroxy groups can freely be selected from compounds having two or more hydroxy groups in a molecule and polymerizable with an isocyanate. Examples thereof include ethylene glycol, propylene glycol, butanediol and polyethylene glycol.

Other examples of the compound having hydroxy groups include polymers having reactive hydroxy groups and oligomers thereof, such as an acrylic polyol and its oligomer, and a polyester polyol and its oligomer.

[Developer layer-forming step]

The developer layer-forming step in the invention is a step of forming a developer layer composed of a toner and a carrier on the surface of the developer support disposed opposite the latent image support.

The developer layer formed on the surface of the developer support is obtained by adhering the toner to a so-called magnetic brush in which a magnetic carrier is provided on the surface of the developer support in the form of a brush.

The toner and the carrier are described below separately.

A. Toner

The toner used in the invention has the following structure.

The toner is composed of color particles containing at least a binder resin and a coloring agent, (a) a volume average particle diameter of the color particles is between 2.0 and 5.0 $\mu$m, the ratio of the color particles of 1.0 μm or less is 20% or less in terms of the number of distribution, and the ratio of the color particles exceeding 5.0 μm is 10% or less in terms of the number of distribution, and (b) the coloring agent is pigment particles.

With respect to the toner used in the invention, the characteristic constructions and the other constructions in the invention are described in detail separately.

<Characteristic constructions in the invention>

(a) Particle diameter and particle size distribution of the colored particles

As stated above, it is indispensable, for improving the fine line reproducibility and the gradation, that the volume average particle diameter of the color particles is 5.0 μm or less. When it exceeds 5.0 μm, the ratio of coarse particles is increased to decrease the fine line reproducibility and the gradation. Incidentally, what the invention terms the "fine line reproducibility" means whether or not a fine line having a width of from 30 to 60 μm, preferably from 30 to 40 μm can truly be reproduced. Further, whether or not a dot having the same diameter can be reproduced is also taken into consideration.

Meanwhile, it is indispensable that the lower limit of the volume average particle diameter of the color particles is 2.0 μm or more. When it is less than 2.0 μm, various disadvantages accompanied by the decrease in the powder characteristics seem likely to occur that a powder fluidity as a toner, a developing property or a transferring property is worsened and a cleaning property of a toner remaining on the surface of the photoreceptor is decreased.

Accordingly, the volume average particle diameter of the color particles is between 2.0 and 5.0 μm, preferably between 2.0 and 4.5 μm, more preferably between 2.0 and 4.0 μm, further preferably between 2.0 and 3.5 μm. In the invention, the range of the volume average particle diameter is defined as mentioned above, making it possible to improve the fine line reproducibility and the gradation of the resulting image, to decrease the amount of the toner of the toner image to be formed on the organic photoreceptor as the latent image support and to suppress the staining or the wearing-out of the organic photoreceptor.

In the invention, the particle size distribution of the color particles is further defined. Specifically, it is indispensable to use a particle size distribution that in all the color particles, the ratio of the color particles of 1.0 μm or less is 20% or less in terms of the number of distribution and the ratio of the color particles exceeding 5.0 μm is 10% or less in terms of the number of distribution.

When the ratio of the color particles of 1.0 μm or less among all the color particles exceeds 20% in terms of the number of distribution, fogging of a non-image area tends to occur, and unsatisfactory cleaning tends to occur. The ratio of the color particles of 1.0 μm or less among all the color particles is further preferably 10% or less in terms of the number of distribution.

Meanwhile, when the ratio of the color particles exceeding 5.0 μm among all the color particles exceeds 10% in terms of the number of distribution, the improvement of the fine line reproducibility intended by the invention cannot be achieved. The ratio of the color particles exceeding 5.0 μm among all the color particles is further preferably 5% or less in terms of the number of distribution.

The particle size distribution is adjusted to an appropriate range as mentioned above, along with the volume average particle diameter of the color particles, making it possible to easily obtain the toner having the charge amount distribution (specifically, the q/d value to be described later) which is appropriate for preventing the disorder of the image owing to the unclear electrostatic latent image formed on the surface of the organic photoreceptor. Further, when the particle size distribution of the color particles is appropriately adjusted as mentioned above, the non-electrostatic adhesion between the toner and the organic photoreceptor in the development nip portion during the development step is appropriately controlled, and the reverse flying of the toner once adhered to the organic photoreceptor less occurs immediately after passage through the development nip portion as the development electric field becomes weak. Thus, the sharpness of the image is increased, and the disorder of the image less occurs.

Further, even in the transferring step, the appropriate particle size distribution of the color particles effectively prevents the toner flying of the image passed through the transfer nip portion, and the disorder of the image less occurs.

As the parameter defining the large particle diameter in the particle size distribution of the color particles, the ratio (%), in terms of the number of distribution, of the color particles exceeding 5.0 μm is used in the invention. However, the standard particle diameter can also be defined by the other value. Specifically, when 4.0 μm is used as a standard particle diameter, the ratio of the color particles of 4.0 μm or less is preferably 75% or more in terms of the number of distribution. Incidentally, in view of the volume average particle diameter and the particle size distribution of the color particles in the toner of the invention, when the ratio of the color particles of 4.0 μm or less among all the color particles is 75% or more in terms of the number of distribution, the ratio of the color particles exceeding 5.0 μm is generally 10% or less in terms of the number of distribution.

With respect to the particle size distribution of the color particles of the toner in the invention, the ratio of the color particles of from 1.0 to 2.5 μm among all the color particles is preferably between 5 and 50%, more preferably between 10 and 45% in terms of the number of distribution for more improving the effects of the invention. When the ratio of the color particles of from 1.0 to 2.5 μm exceeds 50% in terms of the number of distribution, such a selective development tends to occur that the color particles having a larger particle diameter are selectively consumed in the development and the color particles having a relatively small diameter of from 1.0 to 2.5 μm are less consumed, and disadvantages such as fogging and unsatisfactory cleaning are liable to occur in reproduction of many sheets. Thus, it is undesirable. Meanwhile, when the ratio of the color particles of from 1.0 to 2.5 μm is less than 5% in terms of the number of distribution, the reproducibility of fine dots tends to be decreased. Thus, it is undesirable.

In order to obtain the color particles having such a particle size distribution, it is advisable to appropriately determine the conditions for pulverization and classification when the color particles are obtained by pulverization or the conditions for polymerization when the color particles are obtained by polymerization. When the particle diameter is minimized as much as possible by an ordinary pulverization method, excess pulverization less occurs, and a pulverized product having a particle size distribution close to that of the color particles in the invention is obtained. It is almost unnecessary to adjust the particle size distribution with a classifier. Even when it is necessary to adjust the particle size distribution, the pulverization is preferable in view of the reduction of the production cost because an amount of a pulverized product to be removed is small.

The particle size distribution of the color particles can be measured by various methods. In the invention, the measurement is conducted using Coulter Counter Model TA2 (supplied by Coulter Counter) with an aperture diameter of 50 μm. Only when the number distribution of the color particles of 1.0 μm or less is measured, the aperture diameter is set at 30 μm.

Specifically, from 2 to 3 droplets of a dispersion (surfactant: Triton X100) and a sample to be measured were added to 10 g/liter of a sodium chloride aqueous solution, and the mixture was dispersed for 1 minute with a sonicator. This dispersion was measured using the above-mentioned apparatus.

(b) Coloring agent

In the toner used in the invention, in order to achieve a sufficient image density even when the amount of the toner per unit area of the image is reduced and to ensure a water resistance, a light resistance or a solvent resistance of the image, pigment particles having a high coloring power and excellent in a water resistance, a light resistance or a solvent resistance are used as a coloring agent contained in the color particles.

(c) Relationship of a charge amount q and a particle diameter d (q/d value):

It is advisable that the charged state of each of the colored particles is appropriately controlled in the toner of the invention. That is, not the charge amount of the overall toner but the charged state of each of the toner particles greatly influences the resulting image. Meanwhile, since the particle diameter of each of the toner particles also greatly influences the image, the relationship to the image quality is not satisfactorily explained by defining only the frequency distribution of the charge amount of each of the toner particles. Accordingly, it is advisable that the relationship of the charge amount and the particle diameter of each of the toner particles is appropriately defined in the toner used in the invention.

That is, when the charge amount of the toner in an atmosphere of a temperature of 20° C. and a humidity of 50% is represented by q(fC) and the particle diameter of the toner is represented by d (μm), it is preferable that in the frequency distribution of the q/d value, the peak value is 1.0 or less and the bottom value is 0.005 or more. With respect to the q/d value, the above-mentioned numerical definition is applied as such in case of a positively charged toner, while this numerical definition is applied after the value of the charge amount q(fC) of the toner is inverted from the positive value to the negative value in case of the negatively charged toner.

The atmosphere of the temperature of 20° C. and the humidity of 50% is used as a measurement atmosphere because it is generally most appropriate to define the charge amount in a standard atmosphere of room temperature for achieving the properties intended by the invention. That is, the toner which meets the above-mentioned conditions in such a standard atmosphere is not deviated much from the appropriate charge amount distribution in obtaining the high-quality image intended by the invention even though the conditions of the atmosphere somewhat change, making it possible to exhibit a high performance quite stably. Needless to say, the toner having the above-mentioned charge amount distribution is preferable in an atmosphere of a higher temperature and a higher humidity or in an atmosphere of a lower temperature and a lower humidity.

When the q/d value is measured in each toner and the frequency distribution is graphically represented, an almost regular distribution with an upper limit and a lower limit is provided. In the invention, the q/d value of the peak in the graph is a peak value, and the q/d value of the lower limit (lower limit after the positive value is converted into the negative value in case of the negatively charged toner) is a bottom value.

In the toner used in the invention, the peak value in the frequency distribution of the q/d value is preferably 1.0 or less, more preferably 0.80 or less, further preferably 0.70. When the peak value exceeds 1.0, the adhesion of the toner to the carrier or the surface of the photoreceptor is increased even when the frequency distribution is narrowed. Accordingly, there is a likelihood that the developing property or the transferring property is worsened to decrease the image density, and that the cleaning property of the toner remaining on the surface of the photoreceptor is decreased. Thus, it is undesirable. Further, when the peak value exceeds 1.0 and the charge distribution is widened, the unevenness of the chargeability of each toner is increased in addition to the above-mentioned problems. Thus, there is a likelihood that the developing property or the transferring property is non-uniform.

The flying and the reverse flying of the toner that occurs in the development nip portion during the developing step occur by the action of the development electric field. However, when the q/d value is reduced as noted above, the flying of the toner less occurs immediately after passage through the development nip portion as the development electric field becomes weak. On the other hand, when the particle size distribution of the toner is appropriately adjusted as noted above, the non-electrostatic adhesion between the toner and the organic photoreceptor is appropriately controlled. The toner once adhered to the organic photoreceptor less causes the reverse flying immediately after passage through the development nip portion as the development electric field becomes weak. Accordingly, in the image passed through the development nip portion, especially in the edge portion thereof, the flying of the toner is soon finished when the development electric field becomes weak. Consequently, the sharpness of the image is improved, and the disorder of the image less occurs.

Further, the q/d value and the particle size distribution of the toner are appropriately adjusted even in the transferring step, with the result that in the image passed through the development nip portion, especially in the edge portion thereof, the flying of the toner is effectively prevented and the disorder of the image less occurs.

Meanwhile, when the q/d value is too close to 0 or becomes a positive or negative reversed value (namely a toner of a reversed polarity), dropping occurs in the image portion or fogging occurs in the non-image portion at times. Accordingly, it is required that the bottom value in the frequency distribution of the q/d value is maintained at a fixed value. Specifically, it is preferably 0.005 or more, more preferably 0.01 or more, further preferably 0.02 or more, especially preferably 0.025 or more.

The upper limit (upper limit in the absolute value in case of the negatively charged toner) in the frequency distribution of the q/d value is not particularly defined. The frequency distribution of the q/d value is, as already mentioned, a nearly regular distribution. When the peak value and the bottom value are defined, the upper limit is naturally determined.

The frequency distribution of the q/d value can be measured by CSG described in, for example, JP-A-57-79958. The measuring method is specifically described below.

FIG. 1 is a simplified perspective view of a measuring apparatus 10 for measuring a frequency distribution of a q/p value by CSG. The measuring apparatus 10 comprises a cylindrical drum 12, a filter 14 for closing the lower opening thereof, a mesh 16 for closing the upper opening, a sample feeding cylinder 18 protruded from the center of the mesh 16 to the inside of the drum 12, a suction pump (not shown) for sucking air from the lower opening of the drum 12 and an electric field generation device (not shown) for providing an electric field E from the side of the drum 12.

The suction pump is adapted such that air inside the drum 12 is sucked uniformly throughout the whole surface of the filer 14 via the filter 14 at the lower opening of the drum 12. Consequently, air flows from the mesh 16 at the upper opening, and a laminar flow with a fixed air velocity Va occurs vertically inside the drum 12. Further, the uniform and constant electric field E is provided in the direction perpendicular to the air stream.

Particles of a toner to be measured are gradually charged (dropped) from the sample feeding cylinder 18 to the inside of the drum 12 in the above-mentioned state. The toner particles charged from the sample outlet 20 at the tip of the sample feeding cylinder 18 fly vertically while undergoing the influence of the laminar air flow unless influenced by the electric field E, and reach the center O of the filter 14 (at this time, a distance k between the sample outlet 20 and the filter 14 is a straight flying distance of the toner). The filter 14 is a polymer filter of a coarse mesh. Air passes well therethrough, but the toner particles do not pass, remaining on the filter 14. However, a charged toner is influenced by the electric field E, and reaches the filter 14 by being deviated from the center O to the forward direction of the electric field E (point T in FIG. 1). The distance x (displacement) between this point T and the center O is measured, and the frequency distribution thereof and then the frequency distribution of the q/d value are obtained (in the invention, actually, the peak value and the bottom value were directly obtained by the image analysis).

Specifically, the relationship of the displacement x (mm) obtained by the measuring apparatus 10, the charge amount q(fC) of the toner and the particle diameter d ($\mu$m) of the toner is represented by formula (5).

$$q/d=(3\pi\eta Va/kE)\times x \quad (5)$$

wherein $\eta$ represents a viscosity (kg/m·sec) of air, Va represents an air velocity (m/sec), k represents a straight flying distance (m) of a toner, and E represents an electric field (V/m).

In the invention, the measurement is conducted by setting the conditions of the measuring apparatus 10 shown in FIG. 1 such that the conditions of formula (5) become the following values.

Air viscosity $\eta=1.8\times10^{-5}$ (kg/m·sec)

Air velocity Va=1 (m/sec)

Toner straight flying direction k=10 (cm)

Electric field E=190 V/cm

These values are put into formula (5) as follows.

$$q(\mathrm{fC})/d(\mu\mathrm{m})\approx0.09\cdot x$$

When the toner particles to be measured are charged into the sample feeding cylinder 18, the toner has to be charged in advance. The q/d value of the toner has to have the above-mentioned frequency distribution when the electrostatic latent image is actually developed. The toner to be measured is mixed with a carrier to form a two-component developer, and this developer is shaken under conditions close to those of the conditions of the apparatus, and then measured with respect to the frequency distribution of the q/d value. This is adapted to the purport of the invention.

Accordingly, in the invention, the charge conditions of the toner particles for developing the electrostatic latent image, which are to be measured, were defined as follows (it is, of course, preferable that the toner is directly sampled from an apparatus when actually developing the electrostatic latent image, and measured, and the resulting conditions satisfy the conditions of the frequency distribution of the q/d value).

In the invention, the electrostatic latent image developer comprising the toner and the carrier as actually used was put into a glass bottle, and charged by being stirred for 2 minutes with a turbulent shaker. This developer was measured with respect to the frequency distribution of the q/d value.

In this manner, the frequency distribution of the q/d value can be obtained. Of course, the frequency distribution of the q/d value can be obtained by the method other than CSG in the invention. However, the error is reduced by CSG.

(d) External additive

In the toner used in the invention, it is advisable to add the external additive to control the charge. Especially, the addition of the external additive is quite effective for appropriately adjusting the q/d value.

Examples of the material of the inorganic fine powder which can be used as the external additive include metal oxides such as titanium oxide, tin oxide, zirconium oxide, tungsten oxide and iron oxide; nitrides such as titanium nitride; silicon oxide; and titanium compounds. The amount of the external additive is preferably between 0.05 and 10 parts by weight, more preferably between 0.1 and 8 parts by weight per 100 parts by weight of the color particles.

The inorganic fine powder can be added to the toner by a known method in which the inorganic fine powder and the color particles are charged into a Henschel mixer and mixed.

Further, in the toner used in the invention, it is advisable that at least one or more types of superfine particles having a primary particle average diameter of at least 30 nm and at most 200 nm and one or more types of hyperfine particles having a primary particle average diameter of at least 5 nm and less than 30 nm are used as the external additive for providing good characteristics of the powder such as a powder fluidity and a powder adhesion, for preventing the decrease in the transfer efficiency and the chargeability, for alleviating the environmental dependence and for appropriately adjusting the q/d value.

The superfine particles act to decrease the adhesion between the color particles or between the color particles and the latent image support or the carrier and to prevent the decrease in the developing property, the transferring property or the cleaning property. The primary particle average diameter of the superfine particles is at least 30 nm and at most 200 nm, more preferably at least 35 nm and at most 150 nm, further preferably at least 35 nm and at most 100 nm. When it exceeds 200 nm, the superfine particles tend to be separated from the toner, and the effect of reducing the adhesion cannot be exhibited. Meanwhile, when it is less than 30 nm, the superfine particles come to perform the action of the hyperfine particles to be described later.

The hyperfine particles contribute to improving the fluidity of the toner (color particles), decreasing the agglomeration and improving the environmental stability by the effect of suppressing heat agglomeration. The primary particle average diameter of the hyperfine particles is at least 5 nm and less than 30 nm, more preferably at least 5 nm and less than 29 nm, further preferably at least 10 nm and less than 29 nm. When it is less than 5 nm, the hyperfine particles tend to be embedded in the surface of the color particles owing to the stress that the toner undergoes. Meanwhile, when it is 30 nm or more, the hyperfine particles come to perform the action of the superfine particles. By the way, the "primary particle diameter" in the invention refers to a corresponding spherical primary particle diameter.

The superfine particle are fine particles composed of metal oxides such as hydrophobic silicon oxide, titanium oxide, tin oxide, zirconium oxide, tungsten oxide and iron oxide, nitrides such as titanium nitride and titanium compounds. Fine particles composed of hydrophobic silicon oxide are preferable. The fine particles are rendered hydrophobic with a hydrophobic agent. As the hydrophobic agent, a chlorosilane, an alkoxysilane, a silazane and a silylated isocyanate are all available. Specific examples thereof include methyltrichlorosilane, dimethyldichlorosilane, trimethylchlorosilane, methyltrimethoxysilane, dimethyldimethoxysilane, methyltriethoxysilane, dimethyldiethoxysilane, isobutyltrimethoxysilane, decyltrimethoxysilane, hexamethyldisilazane, tert-butyldimethylchlorosilane, vinyltrichlorosilane, vinyltrimethoxysilane and vinyltriethoxysilane.

The hyperfine particles are fine particles composed of hydrophobic titanium compounds, metal oxides such as silicon oxide, titanium oxide, tin oxide, zirconium oxide, tungsten oxide and iron oxide, and nitrides such as titanium nitride. Of these, the fine particles of the titanium compounds are preferable.

The fine particles of the titanium compounds are preferably a reaction product of metatitanic acid and a silane compound which is highly hydrophobic, which less allows formation of an agglomerate because the burning treatment is not conducted, and which has a good dispersibility in the external addition. At this time, as the silane compound, an alkylalkoxysilane compound and/or a fluoroalkylalkoxysilane compound which allows satisfactory charge control of the toner and which can reduce the adhesion to the carrier or the photoreceptor is preferably used.

The metatitanic acid compound which is a reaction product of metatitanic acid and an alkylalkoxysilane compound and/or a fluoroalkylalkoxysilane compound is preferably a product obtained by peptizing metatitanic acid formed through hydrolysis with sulfuric acid, and then reacting metatitanic acid as a base with an alkylalkoxysilane compound and/or a fluoroalkylalkoxysilane compound. Examples of the alkylalkoxysilane to be reacted with metatitanic acid include methyltrimethoxysilane, ethyltrimethoxysilane, propyltrimethoxysilane, isobutyltrimethoxysilane, n-butyltrimethoxysilane, n-hexyltrimethoxysilane, n-octyltrimethoxysilane and n-decyltrimethoxysilane. Examples of the fluoroalkylalkoxysilane compound include trifluoropropyltrimethoxysilane, tridecafluorooctyltrimethoxysilane, heptadecafluorodecyltrimethoxysilane, heptadecafluorodecylmethyldimethoxysilane, (tridecafluoro-1,1,2,2-tetrahydrooctyl) triethoxysilane, (3,3,3-trifluoropropyl)trimethoxysilane, (heptadecafluoro-1,1,2,2-tetrahydrodecyl)triethoxysilane and 3-(heptafluoroisopropoxy)propyltriethoxysilane.

The use of the two types of external additives, the superfine particles and the hyperfine particles, come to bring forth the effects provided by the addition of both of these additives.

However, when the amounts of the external additives are too large, free external additives (not adhered to the color particles) occur, staining the latent image support and the carrier surface. Further, unless certain amounts of the superfine particles and the hyperfine particles are present, the effects provided by the addition of both of the particles are not given. Still further, when the amounts of the superfine particles are too large, no effect of improving the powder fluidity is obtained. When the amounts of the hyperfine particles are too large, no effect of improving the powder adhesion is obtained. Accordingly, there is a need to appropriately control the amounts of the external additives.

The manifestation of the effects by the addition of the external additives and the change in the characteristics of the powder are not dependent on the absolute amounts of the external additives to be added but on the coating rate to the surfaces of the color particles. The coating rate to the surfaces of the color particles is now described.

Figure 2:
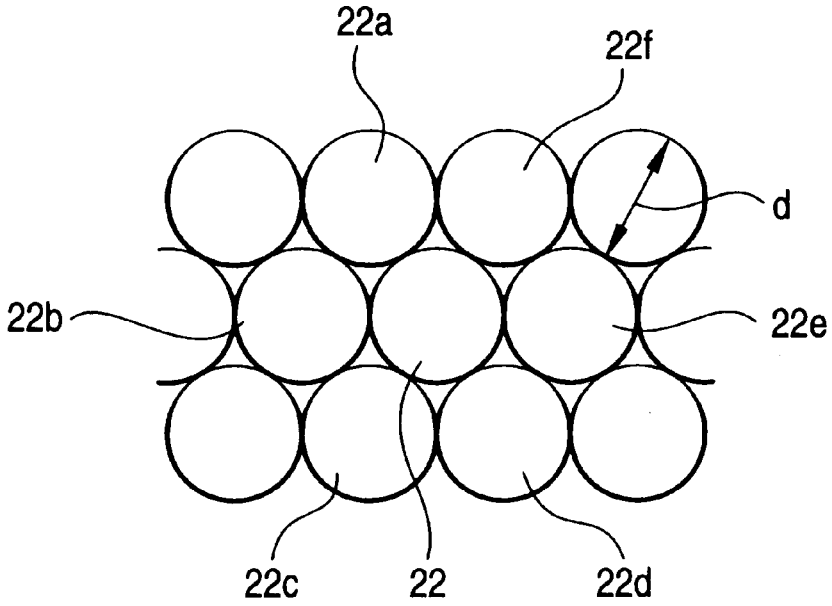
FIG. 2 is an enlarged plane view of a part of a surface of color particles for describing a coating rate of an external additive to surfaces of color particles.

Assuming that the external additive is a true sphere of a fixed size (diameter d) and unagglomerated primary particles are adhered to the surfaces of the color particles in a single layer, a densest packing (arranged in the densest state) of the external additive adhered to the surfaces of the color particles is, as shown in FIG. 2, a hexagonal densest packing in which six external additives 22*a* to 22*f* are adjacent to one external additive 22 (FIG. 2 is an enlarged plan view of only a part of the surface of the color particle).

On the assumption that the state shown in FIG. 2 indicates a coating rate of 100% as an ideal state, the amount of the actual external additive relative to the amounts of the actual color particles is expressed by %, and this rate is defined as the coating rate in the invention.

That is, in the actual state, the volume average particle diameter of the color particles is represented by D ($\mu$m), the true specific gravity of the color particles is represented by $\rho_t$, the primary particle average diameter of the external additive represented by d ($\mu$m), the true specific gravity of the external additive is represented by $\rho_a$ and the ratio (x/y) of the amount x(g) of the external additive to the amount y (g) of the color particles is represented by C, the coating rate F (%) is:

$$F=C/\{2\pi\cdot d\cdot\rho_a/(\sqrt{3}\cdot D\cdot\rho_t)\}\times 100$$

This is arranged as represented by formula (1).

$$F=\sqrt{3}\cdot D\cdot\rho_t\cdot(2\pi\cdot d\cdot\rho_a)^{-1}\cdot C\times 100 \quad (1)$$

wherein F represents a coating rate (%), D represents a volume average particle diameter ($\mu$m) of color particles, $\rho_t$ represents a true specific gravity of color particles, d represents a primary particle average diameter ($\mu$m) of an external additive, $\rho_a$ represents a true specific gravity of an external additive, and C represents a ratio (x/y) of an amount x(g) of an external additive to an amount y(g) of color particles.

In the invention, it is preferable that the coating rate of the external additive to the surfaces of the color particles obtained by formula (1) is 20% or more on both of the superfine particles Fa and the hyperfine particles Fb and the sum of the coating rates of all the external additives is 100% or less. Incidentally, the "sum of the coating rates of all the external additives" refer to a sum obtained by calculating the coating rates of the respective external additives to be added and totaling the resulting coating rates of the respective external additives.

When the coating rate Fa of the superfine particles is less than 20%, no effect provided by the addition of the superfine particles is obtained. The coating rate Fa of the superfine particles is preferably between 20 and 80%, more preferably between 30 and 60%.

When the coating rate Fb of the hyperfine particles is less than 20%, no effect provided by the addition of the hyperfine particles is obtained. The coating rate Fb of the hyperfine particles is preferably between 20 and 80%, more preferably between 30 and 60%.

When the sum of the coating rates of all the external additives exceeds 100%, free external additives are formed in large amounts, with the result that the photoreceptor and the carrier surface are stained with the external additives. The sum of the coating rates of all the external additives is preferably between 40 and 100%, further preferably between 50 and 90%.

With respect to the relationship of the coating rate Fa (%) of the superfine particles and the coating rate Fb (%) of the hyperfine particles, it is advisable to satisfy formula (4).

$$0.5 \leqq Fb/Fa \leqq 4.0 \quad (4)$$

When it is deviated from this range, the effect provided by the addition of the superfine particles or the hyperfine particles is less obtained. Thus, it is undesirable. In order to optimize the effect provided by the addition of the superfine particles or the hyperfine particles, it is more preferable to meet formula (4').

$$0.5 \leqq Fb/Fa \leqq 2.5 \quad (4')$$

The superfine particles and the hyperfine particles can be added to the toner by a known method in which the superfine particles, the hyperfine particles and the color particles are charged into a Henschel mixer, and mixed.

[Other constructions]

(i) Color particles

In the toner used in the invention, the color particles contain at least the binder resin and the coloring agent.

In the binder resin contained in the color particles, the glass transition point is preferably between 50 and 80° C., more preferably between 55 and 75° C. When the glass transition point is less than 50° C., the heat stability is decreased. When it exceeds 80° C., the low-temperature fixing property is decreased. Thus, these are undesirable.

Further, the softening point of the binder resin is preferably between 80 and 150° C., more preferably between 90 and 150° C., further preferably between 100 and 140° C. When the softening point is less than 80° C., the heat stability is decreased. When it exceeds 150° C., the low-temperature fixing property is decreased. Thus, these are undesirable.

Further, the number average molecular weight of the binder resin is preferably between 1,000 and 50,000, and the weight average molecular weight thereof is preferably between 7,000 and 500,000.

The binder resin is not particularly limited, and known binder resins are used. A styrene polymer, a (meth)acrylate polymer and a styrene-(meth)acrylate polymer obtained by polymerizing one or more types selected appropriately from the following styrene monomer, (meth)acrylate monomer, another acrylic or methacrylic monomer, vinyl ether monomer, vinyl ketone monomer and N-vinyl compound monomer are preferably used.

Examples of the styrene monomer include styrene; and styrene derivatives such as o-methylstyrene, ethylstyrene, p-methoxystyrene, p-phenylstyrene, 2,4-dimethylstyrene, p-n-octylstyrene, p-n-decylstyrene, p-n-dodecylstyrene and butylstyrene.

Examples of the (meth)acrylate monomer include (meth) acrylates such as methyl (meth)acrylate, ethyl (meth) acrylate, propyl (meth)acrylate, butyl (meth)acrylate, isobutyl (meth)acrylate, n-octyl (meth)acrylate, dodecyl (meth) acrylate, 2-ethylhexyl (meth)acrylate, stearyl (meth) acrylate, phenyl (meth)acrylate and dimethylaminoethyl (meth)acrylate.

Examples of another acrylic or methacrylic monomer include acrylonitrile, methacrylamide, glycidyl methacrylate, N-methylolacrylamide, N-methylolmethacrylamide and 2-hydroxyethyl acrylate.

Examples of the vinyl ether monomer include vinylmethyl ether, vinylethyl ether and vinylisobutyl ether.

Examples of the vinyl ketone monomer include vinyl methyl ketone, vinyl hexyl ketone and methyl isopropenyl ketone.

Examples of the N-vinyl compound monomer include N-vinyl compounds such as N-vinylpyrrolidone, N-vinylcarbazole and N-vinylindole.

In the invention, the polyester is preferably used as the binder resin in view of the fixing property. As this polyester, a polyester formed by polycondensation of a polybasic carboxylic acid and a polyhydric alcohol can be used.

Examples of the polyhydric alcohol monomer include aliphatic alcohols such as ethylene glycol, propylene glycol, 1,3-butanediol, 1,4-butanediol, 2,3-butanediol, diethylene glycol, 1,5-pentanediol, 1,6-hexanediol and neopentyl glycol; alicyclic alcohols such as cyclohexane dimethanol and hydrogenated bisphenol; bisphenol derivatives such as a bisphenol A ethylene oxide adduct and a bisphenol A propylene oxide adduct. Examples of the polybasic carboxylic acid include aromatic carboxylic acids such as phthalic acid, terephthalic acid and phthalic anhydride; saturated and unsaturated carboxylic acids such as succinic acid, adipic acid, sebacic acid, azelaic acid and dodecenylsuccinic acid; and acid anhydrides thereof.

As the coloring agent contained in the color particles, known pigments or dyes can be used. However, when the amount of the coloring agent is too large, it influences the charging characteristics of the toner. Therefore, it is advisable that a pigment which exhibits a high coloring property in a small amount is used in the invention.

Examples of the pigment which can be used include carbon black, nigrosine, graphite, C. I. pigment red 48:1, 48:2, 48:3, 53:1, 57:1, 112, 122, 123, 5, 139, 144, 149, 166, 177, 178, 222, C. I. pigment yellow 12, 14, 17, 97, 180, 188, 93, 94, 138, 174, C. I. pigment orange 31, C. I. pigment orange 43, C. I. pigment blue 15:3, 15, 15:2, 60 and C. I. pigment green 7. Of these, carbon black, C. I. pigment red 48:1, 48:2, 48:3, 53:1, 57:1, 112, 122, 123, C. I. pigment yellow 12, 14, 17, 97, 180, 188 and C. I. pigment blue 15:3 are preferable. These pigments may be used either singly or in combination.

The present inventors have already proposed a method in which a dispersed particle average diameter in a binder resin of pigment fine particles as a toner coloring agent is adjusted to 0.3 μm or less in terms of the corresponding circle diameter by a melt flushing method in order to improve a coloring power and a transparency of a color toner (JP-A-4-242752). This method is quite effective for the toner in the invention in which the density of the coloring agent in the color particles has to be increased. That is, the melt flushing method for dispersing pigment particles into a binder resin is a method in which a water content in a pigment hydrous cake during a pigment production step is replaced with a molten binder resin. This method can easily make the dispersed particle average diameter in the binder resin of the pigment fine particles 0.3 μm or less in terms of the corresponding circle diameter. When such pigment fine particles having a small particle diameter are used, it is possible to ensure the transparency of the toner and to allow good color reproduction. Thus, this method is desirable.

In the toner used in the invention, the color particles have the volume average particle diameter of 5.0 μm or less, and it is necessary to increase the coloring power of each of the color particles. Especially in case of the full color image in which the color particles are overlaid on the transfer material for color formation, unless the transparency of the color particles is good, the color formation of the lower layer is neglected by the color particles of the upper layer in developing a secondary color such as red or green or a tertiary color such as process black. Consequently, good color reproduction is not conducted at times. However, this problem can be solved by adjusting the dispersed particle average diameter of the pigment particles in the binder resin to 0.3 μm or less in terms of the corresponding circle diameter.

Incidentally, the corresponding circle diameter of the dispersed particle average diameter in the binder resin of the pigment fine particles in the invention is measured as follows. That is, part of the color particles are taken out, and wrapped with a resin. The thin member for observation is cut out for observing the dispersed state of the pigment particles in the color particles. An enlarged photograph thereof with 15,000× magnification is obtained using a transmission electron microscope. The area of the pigment particles is measured using an image analyzer, and a diameter of a circle corresponding to this area is calculated. This calculated value is the corresponding circle diameter.

The toner in the invention has, as already stated, the small particle diameter. No satisfactory image density is obtained with the same pigment concentration as that of the ordinary toner having a large particle diameter. Further, when the toner of the invention is said to have the small particle diameter, the volume average particle diameter is in a wide range of from 2.0 μm to 5.0 μm, and this gives a great difference in the amount (TMA) of the toner per unit area on the transfer material in the solid image. Accordingly, it is advisable to determine the necessary pigment concentration depending on TMA.

Assuming the toner is formed on the transfer material in the state of a monolayer, TMA is determined by the volume average particle diameter D (μm) and the specific gravity a of the color particles. It is advisable that the pigment concentration C (%) of the color particles satisfies the following relationship (2).

$$25 \leqq a \cdot D \cdot C \leqq 90 \quad (2)$$

When the a·D·C (hereinafter abbreviated as "aDC") value is less than 25, the coloring power is not satisfactory, and a desired image density is hardly obtained. When the amount of the toner formed in the development is increased to obtain the desired image density, the thickness of the image is increased although the diameter is decreased, the fine line reproducibility is decreased, and the transferring property is also decreased. Thus, it is undesirable.

Meanwhile, when the aDC value exceeds 90, a satisfactory image density is obtained, but there is a likelihood of disadvantages that staining tends to occur owing to scattering of a small amount of the toner on the non-image area and a melt viscosity of the color particles is increased by a reinforcing effect of a pigment to decrease a fixing property. Thus, it is undesirable.

Further, the coloring power differs depending on the difference in the color. It is preferable to satisfy the following relationships (2-1) to (2-4) for each color.

$$\text{cyan: } 25 \leqq a \cdot D \cdot C \leqq 90 \quad (2\text{-}1)$$

$$\text{magenta: } 25 \leqq a \cdot D \cdot C \leqq 60 \quad (2\text{-}2)$$

$$\text{yellow: } 30 \leqq a \cdot D \cdot C \leqq 90 \quad (2\text{-}3)$$

$$\text{black: } 25 \leqq a \cdot D \cdot C \leqq 60 \quad (2\text{-}4)$$

Since the pigments of the same color have different coloring powers depending on the different chemical structural formulas, the pigment concentration may be determined depending on the type of the pigment, preferably within the above-mentioned ranges.

The color particles can be produced by a known method such as a pulverization method, a suspension polymerization method or an emulsion polymerization. In the invention, it is advisable to employ the pulverization method as stated above. In the pulverization method, the binder resin, the coloring agent and as required, other additives are preliminarily mixed, melt-kneaded with a kneader, cooled, and then pulverized, after which the powder is classified according to a regular particle size distribution.

(ii) Other additives

The toner in the invention may contain an antistatic agent and a mold release agent, as required, unless the color reproducibility and the transparency are impaired. Examples of the antistatic agent include a chromium-type azo dye, an iron-type azo dye, an aluminum azo dye, a salicylic acid metal complex and an organoboron compound. Examples of the mold release agent include polyolefins such as low-molecular propylene and low-molecular polyethylene, paraffin waxes, natural waxes such as candelilla wax, carnauba wax and montan wax, and derivatives thereof.

(iii) Degree of agglomeration of the toner

In the toner of the invention, the degree of agglomeration is preferably 30 or less, more preferably 25 or less, further preferably 20 or less. The degree of agglomeration here is an index indicating an agglomeration power between the toners. The larger the value, the higher the agglomeration power between the toners.

When the degree of agglomeration is 30 or less, it is possible to control the decrease in the fluidity by the reduction of the particle diameter of the toner or the decrease in the stirring property with the carrier and to improve the staining, the decrease in the concentration and the shelf stability due to the unsatisfactory supply of the toner, the decrease in the rise of the charge, the poor charge distribution and the decrease in the charge amount. When the degree of agglomeration of the toner is more than 30, the staining owing to the poor fluidity and the poor stirring property with the carrier or the uneven concentration owing to the decrease in the concentration are invited, and the shelf stability is also worsened. By the way, when the two external additives, the superfine particles and the hyperfine particles, are added as stated above, the degree of agglomeration is adjusted to a considerably low value by the balance of the particle diameters and the coating rates of the external additives.

The degree of agglomeration can be measured using a powder tester (supplied by Hosokawa Micron) as described below.

Sieves having openings of 45 μm, 38 μm and 26 μm are arranged in series. Two grams of the toner measured accurately were charged on the uppermost sieve having the opening of 45 μm. Vibration with an amplitude of 1 mm was exerted thereon for 90 seconds. The amount of the toner on each sieve was measured after the vibration. The values were multiplied by 0.5, 0.3 and 0.1 respectively, and the resulting values were multiplied by 100. In the invention, the sample was allowed to stand in an atmosphere of 22° C. and 50% RH for approximately 24 hours. The measurement was conducted in an atmosphere of 22° C. and 50% RH.

B. Carrier

The toner in the invention is used as a two-component electrostatic latent image developer by being mixed with the carrier.

The carrier preferably used along with the toner in the invention is not particularly limited. Examples thereof include magnetic particles such as an iron powder, ferrite, an iron oxide powder and nickel; coating resin-type carrier particles obtained by using magnetic particles as a core and coating the surfaces of the magnetic particles with a known resin such as a styrene resin, a vinyl resin, an ethyl resin, a rosin resin, a polyester resin or a methyl resin or a wax such as stearic acid to form a resin coating layer; and magnetic dispersion-type carrier particles obtained by dispersing magnetic fine particles in a binder resin.

Of these, the coating resin-type carrier having the resin coating layer is especially preferable because the chargeability of the toner and the resistance of the overall carrier can be controlled with the resin coating layer.

The material of the resin coating layer can be selected from any resins which have been so far used in the art as a material of a resin coating layer of a carrier. Further, the resins may be used either singly or in combination.

The particle diameter of the carrier is, in terms of the volume average particle diameter, preferably 45 $\mu$mor less, more preferably between 10 and 40 $\mu$m. The volume average particle diameter of the carrier is set at 45 $\mu$m or less, making it possible to improve the staining or the uneven density owing to the rise of the charge by reducing the particle diameter of the toner (color particles), the worsening of the charge distribution and the decrease in the charge amount.

The mixing ratio of the color toner to the carrier in the invention is preferably 1:100 and 20:100, more preferably between 2:100 and 15:100, further preferably between 3:100 and 10:100 in terms of a weight ratio.

[Developing step]

The developing step in the invention is a step of developing an electrostatic latent image formed on the surface of the latent image support by electrostatically feeding the charged toner in the developer layer formed on the surface of the developer support.

In the invention, it is preferable that the amount (DMA) of the toner of the toner image formed on the latent image support is 0.50 mg/cm$^2$ or less. The amount of the toner on the latent image support is thus controlled to be able to decrease the amount of the toner consumed and further the amount of the external additive consumed. That is, the decrease in the amount of the toner supplied on the latent image support leads to the decrease in the amount of the external additive supplied on the latent image support, making it possible to control the amount of the external additive adhered to the surface of the latent image support and to solve the problems caused by the adhesion of the large amount of the external additive to the latent image support.

No satisfactory image density is obtained at times by merely reducing the amount of the toner of the toner image formed on the latent image support. However, as stated above, in the toner used in the invention, the particle size distribution of the color particles is appropriate, and the pigment concentration in the color particles can be increased. Accordingly, a satisfactory image density can be achieved with the use of such a toner.

As stated above, DMA is preferably 0.50 mg/cm$^2$ or less, more preferably 0.45 mg/cm$^2$ or less, further preferably 0.40 mg/cm$^2$ or less. Incidentally, the upper limit of DMA here referred to is an upper limit when an image area rate in each color is 100%. In the toner image formed on the latent image support, the image area rate naturally varies in each portion. In a portion having an image area rate of 0%, DMA is naturally 0 mg/cm$^2$. Accordingly, there is no need to define the lower limit. However, for ensuring sufficient color formation of the toner in the image obtained, the lower limit of DMA when the image area rate in each color is 100% is preferably 0.10 mg/cm$^2$ or more, more preferably 0.15 mg/cm$^2$ or more.

[Transferring step]

The transferring step in the invention is a step of transferring the toner image formed on the surface of the latent image support onto a transfer material.

The toner image formed on the latent image support is transferred onto the transfer material in the transferring step. When the transfer efficiency is 100%, DMA and TMA are the same value. However, since the transfer efficiency becomes a value slightly smaller than 100%, TMA is a smaller value. In order to obtain an image of a good quality which is visually free from the disorder by reducing the thickness of the image obtained, TMA is preferably 0.40 mg/cm$^2$ or less, more preferably 0.35 mg/cm$^2$ or less, further preferably 0.30 mg/cm$^2$ or less for one color. Incidentally, the upper limit of TMA here referred to is an upper limit when the image area rate in each color is 100%. In the toner image transferred onto the transfer material, the image area rate naturally varies in each portion. In a portion having an image area rate of 0%, TMA is naturally 0 mg/cm$^2$. Accordingly, there is no need to define the lower limit. However, for ensuring sufficient color formation of the toner in the image obtained, the lower limit of TMA when the image area rate in each color is 100% is preferably 0.10 mg/cm$^2$ or more, more preferably 0.15 mg/cm$^2$ or more.

The transfer efficiency here referred to is a ratio (%) of the toner amount (TMA) of the toner image transferred onto the transfer material to the toner amount (DMA) of the toner image formed on the latent image support. The transfer efficiency in the invention is preferably 80% or more, more preferably 90% or more. It is preferable that the transfer efficiency is closer to 100% in view of the cleaning property of the latent image support and the amount of the toner consumed. [Electrophotographic image-forming apparatus to which the image-forming method of the invention is applied]

A specific electrophotographic image-forming apparatus to which the image-forming method of the invention is applied is described below. The electrophotographic image-forming apparatus is, for example, an electrophotographic image-forming apparatus comprising a latent image support, a charge means of a contact charge system, an exposure means for forming an electrostatic latent image with a laser optical system or an LED array, a developing means for forming a toner image using a toner, a transferring means for transferring the toner image onto a transfer material such as a paper, a fixing means for fixing the toner image transferred on a transfer material such as a paper, a static elimination means for removing the electrostatic latent image remaining on the surface of the latent image support and a mechanical cleaning means.

Figure 3:
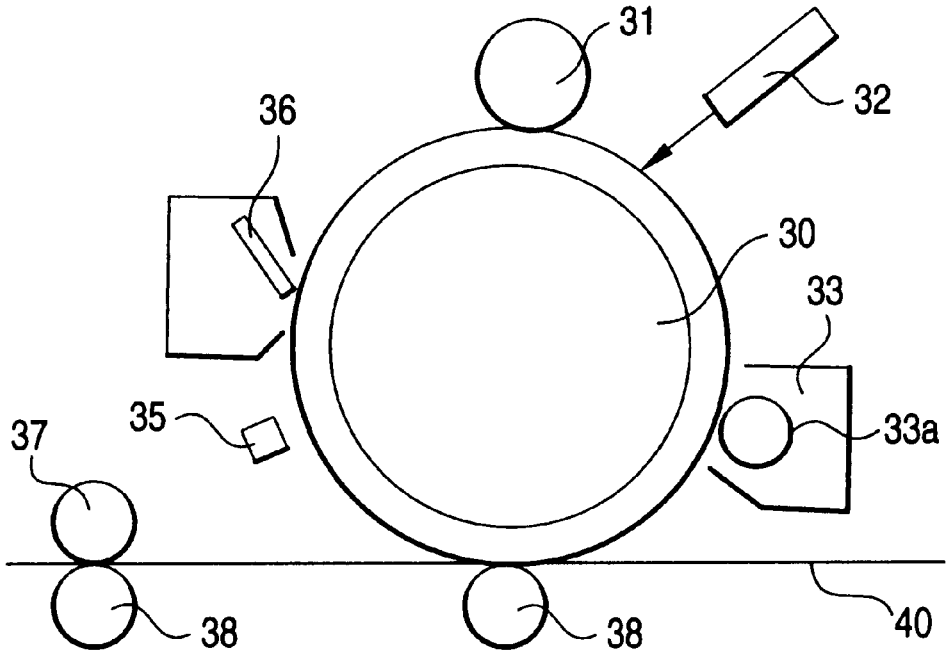
FIG. 3 is a simplified view showing an example of an electrophotographic image-forming apparatus to which the image-forming method of the invention is applied.

FIG. 3 is a simplified view showing an example of an electrophotographic image-forming apparatus to which the image-forming method of the invention is applied. This electrophotographic image-forming apparatus has a photoreceptor 30 as a latent image support, a charge roll 31 as a charging means, a laser exposure optical system 32, a developing unit 33 using a toner and a carrier, a transfer roll 34, a static eliminator 35, a cleaning blade 36 as a mechanical cleaning means, and fixing rolls 37, 38.

With respect to the charging means of the contact charge system, a voltage is applied to the electroconductive member in contact with the surface of the photoreceptor 30 to charge the surface of the photoreceptor 30. The electroconductive member may take the form of a roll like the charge roll 31 in FIG. 3, a brush, a blade or a pin electrode. The roll-like electroconductive member is especially preferable. In the roll-like electroconductive member, an elastic layer is usually formed on the surface of the roll as a core, and a resistant layer is further formed thereon. Still further, a protective layer can be formed on the outside of the resistant layer as required.

The material of the core is an electroconductive material, and iron, copper, brass, stainless steel, aluminum or nickel is generally used. Further, a resin molded article having electroconductive particles dispersed therein is also available.

A material of the elastic layer is an electroconductive or semi-electroconductive elastic material, and it is generally a material obtained by dispersing electroconductive or semi-electroconductive particles in a rubber material.

Examples of the rubber material include EPDM, polybutadiene, natural rubber, polyisobutylene, SBR, CR, NBR, silicone rubber, urethane rubber, epichlorohydrin rubber, SBS, a thermoplastic elastomer, norbornene rubber, fluorosilicone rubber and ethylene oxide rubber.

Examples of the electroconductive or semi-electroconductive particles include carbon black; metals such as zinc, aluminum, copper, iron, nickel, chromium and titanium; metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO and MgO. These materials may be used either singly or in combination.

In the resistant layer and the protective layer, the electroconductive or semi-electroconductive particles are dispersed in the binder resin to control the resistance. Examples of the binder resin include polyolefin resins such as an acrylic resin, a cellulose resin, a polyamide resin, a methoxymethylated nylon, ethoxymethylated nylon, a polyurethane resin, a polycarbonate resin, a polyester resin, a polyethylene resin, a polyvinyl resin, a polyarylate resin, a polythiophene resin, PFA, FEP and PET; and a styrene-butadiene resin. As the electroconductive or semi-electroconductive particles, the same carbon black, metals and metal oxides as those used in the elastic layer are available. The resistivity of the resistant layer and the protective layer is between $10^3$ and $10^{14}$ Ωcm, preferably between $10^5$ and $10^{12}$ Ωcm, further preferably between $10^7$ and $10^{12}$ Ωcm. The film thickness of the resistant layer and the protective layer is between 0.01 and 1,000 μm, preferably between 0.1 and 500 μm, further preferably between 0.5 and 100 μm.

Further, an antioxidant such as hindered phenol or hindered amine, a filler such as clay or kaolin, and a lubricant such as a silicone oil can be added as required.

These layers can be formed by dissolving and dispersing each material in an appropriate solvent to form a coating solution, and coating this coating solution on a product to be coated. Examples of the coating method include known methods such as a blade coating method, a wire bar coating method, a spray coating method, a dip coating method, a bead coating method, an air knife coating method and a curtain coating method.

In order to charge the photoreceptor 30 with the electroconductive member (charge roll 31) as the charge means, a voltage has to be applied to the electroconductive member (charge roll 31). The applied voltage is preferably a DC voltage or a DC voltage superimposed with an AC voltage. The DC voltage superimposed with the AC voltage is especially preferable in view of the uniform charge and the environmental stability.

The intensity of the voltage is preferably between positive or negative 50 and 2,000 V, more preferably between 100 and 1,500 V according to the charge voltage of the photoreceptor 30 required. When the DC voltage is superimposed with the AC voltage, the peak voltage is preferably between 400 and 3,000 V, more preferably between 800 and 2,500 V, further preferably between 1,200 and 2,500 V. A frequency of an AC voltage is between 50 and 20,000 Hz, preferably between 100 and 5,000 Hz.

As the charging means, not only the contact charge system but also a known non-contact charge system can be employed.

The surface of the photoreceptor 30 is uniformly charged with the charge roll 31, and the electrostatic latent image is formed with the laser exposure optical system 32. The developing unit 33 has a developer support 33*a*. Further, the toner of the small particle diameter in the invention is charged therein as a developer along with the carrier, and the developer layer is formed on the surface of the developer support 33*a*.

The electrostatic latent image formed on the surface of the photoreceptor 30 is developed with the toner in the developer layer on the surface of the developer support 33*a* disposed opposite the photoreceptor 30 to form the toner image. In the invention, the amount (DMA) of the toner of the toner image formed on the surface of the photoreceptor 30 is adjusted to 0.50 mg/cm$^2$ or less.

The toner image formed on the surface of the photoreceptor 30 is electrostatically transferred onto the paper 40 as the transfer material with the transfer roll 34, and fixed with heat and/or a pressure by means of the fixing rolls 37, 38.

In the photoreceptor 30 onto which the toner image on the surface has been transferred, the electrostatic latent image remaining on the surface is removed with the static eliminator 35, and the remaining toner containing the external additive is further removed with the cleaning blade 35 as the cleaning means.

The mechanical cleaning means is brought into direct contact with the surface of the photoreceptor 30 to remove the toner, a paper powder and a contaminant adhered to the surface. Known means such as a brush and a roll other than the blade such as the cleaning blade 35 can be employed.

The specific electrophotographic image-forming apparatus to which the image-forming method of the invention is applied has been thus far described by referring to the drawings. However, in the image-forming apparatus to which the invention can be applied, the above-mentioned structure and system are not critical. Any structure and system are available so long as the construction of the invention can be applied.

The invention provides an image-forming method which can give an image excellent in the fine line reproducibility and the gradation and which can suppress deterioration of the latent image support owing to damage or wearing-out of the surface of the latent image support having the organic photoconductive layer.

Further, the invention can provide an image-forming method that does not cause the disorder of the image although using the latent image support having the organic photoconductive layer.

The invention is specifically illustrated by referring to the following Examples. However, the invention is not limited thereto.

<Production Example of an electrostatic latent image developer>

(1) Production of a color toner

1) Production of a flushing pigment

<Magenta flushing pigment>

Seventy parts by weight of a polyester resin (bisphenol A-type polyester: bisphenol A ethylene oxide adduct-cyclohexanedimethanol-terephthalic acid, weight average molecular weight: 11,000, number average molecular weight: 3,500, Tg: 65° C.) and 75 parts by weight of a magenta pigment (C. I. pigment red 57:1) hydrous paste (pigment content 40% by weight) were charged into a kneader, and gradually heated. The kneading was continued at 120° C. After the aqueous phase and the resin phase were separated, water was removed, and the resin phase was further kneaded. Water was removed for dehydration to obtain a magenta flushing pigment.

<Cyan flushing pigment>

A cyan flushing pigment was obtained in the same manner as the magenta flushing pigment except that the magenta pigment hydrous paste was replaced with a cyan pigment (C. I. pigment blue 15:3) hydrous paste (pigment content 40% by weight).

<Yellow flushing pigment>

A yellow flushing pigment was obtained in the same manner as the magenta flushing pigment except that the magenta pigment hydrous paste was replaced with a yellow pigment (C. I. pigment yellow 17) hydrous paste (pigment content 40% by weight).

2) Production of color particles

Production Example 1 of Color Particles

Polyester resin (bisphenol A polyester: bisphenol A ethylene oxide adduct-cyclohexanedimethanol-terephthalic acid, weight average molecular weight: 11,000, number average molecular weight: 3,500, Tg: 65° C.) 66.7 parts by weight
Above-mentioned cyan flushing pigment (pigment content 30% by weight) 33.3 parts by weight These components were melt-kneaded with a Banbury mixer, cooled, and then subjected to pulverization using a jet mill and classification with an air classifier to obtain color particles A. The conditions of the pulverization and the classification were adjusted to the particle size distribution shown in Table 1.

The particle diameter and the particle size distribution of the particles were measured using Coulter Counter Model TA-II supplied by Coulter Counter. At this time, when the average particle diameter of the toner (color particles) exceeded 5 μm, an aperture tube having a diameter of 100 μm was used. When it was 5 μm or less, the measurement was conducted with an aperture diameter of 50 μm. When the number distribution of particles having a particle diameter of 1 μm or less was measured, the measurement was conducted with an aperture diameter of 30 μm (this measurement of the particle diameter applies to the following Examples and Comparative Examples).

Production Example 2 of Color Particles

Color particles B shown in Table 1 were obtained in the same manner as in Production Example 1 of color particles except that the cyan flushing pigment was replaced with the magenta flushing pigment. The conditions of the pulverization and the classification were adjusted to the particle size distribution shown in Table 1.

Production Example 3 of Color Particles

Color particles C shown in Table 1 were obtained in the same manner as in Production Example 1 of color particles except that the amount of the polyester resin was changed to 50% by weight, and 33.3 parts by weight of the cyan flushing pigment were replaced with 50 parts by weight of the yellow flushing pigment. The conditions of the pulverization and the classification were adjusted to the particle size distribution shown in Table 1.

Production Example 4 of Color Particles

Color particles D shown in Table 1 were obtained in the same manner as in Production Example 1 of color particles except that the amount of the polyester resin was changed to 90% by weight, and 33.3 parts by weight of the cyan flushing pigment were replaced with 10 parts by weight of carbon black (primary particle average diameter 40 nm). The conditions of the pulverization and the classification were adjusted to the particle size distribution shown in Table 1.

Production Example 5 of Color Particles

Color particles E shown in Table 1 were obtained in the same manner as in Production Example 1 of color particles except that the amount of the polyester resin was changed to 80% by weight, and the amount of the cyan flushing pigment was changed to 20 parts by weight. The conditions of the pulverization and the classification were adjusted to the particle size distribution shown in Table 1.

Production Example 6 of Color Particles

Color particles F shown in Table 1 were obtained in the same manner as in Production Example 3 of color particles except that the amount of the polyester resin was changed to 73.3% by weight, and the amount of the cyan flushing pigment was changed to 26.7 parts by weight. The conditions of the pulverization and the classification were adjusted to the particle size distribution shown in Table 1.

Table 1 showed, in addition to the particle diameter of the above-obtained color particles, the pigment concentration C (%) of the color particles, the true specific gravity a of the color particles, aDC calculated from these values and the volume average particle diameter D (μm) and the dispersed particle average diameter (corresponding circle diameter: μm) in the binder resin of the pigment fine particles.

TABLE 1

| Type of color particles | Volume average particle diameter D (μm) | Particles of 5.0 μm (% in terms of number of distribution) | Particles of 1.0 to 2.5 μm (% in terms of number of distribution) | Particles of 1.0 μm or less (% in terms of number of distribution) | Color of coloring agent #1 | Type of color particles | Pigment concentration C (%) | True specific gravity a | aDC (a × D × C) | Pigment dispersed particle diameter (μm)*2 |
|---|---|---|---|---|---|---|---|---|---|---|
| A | 3.6 | 1.6 | 38.0 | 2.9 | C | A | 10 | 1.24 | 44.6 | 0.23 |
| B | 3.6 | 2.2 | 36.5 | 3.0 | M | B | 10 | 1.24 | 44.6 | 0.20 |
| C | 3.6 | 1.7 | 37.3 | 2.9 | Y | C | 15 | 1.25 | 67.5 | 0.20 |
| D | 3.5 | 2.0 | 41.2 | 3.0 | K | D | 10 | 1.20 | 42.0 | — |

TABLE 1-continued

| Type of color particles | Volume average particle diameter D (μm) | Particles of 5.0 μm (% in terms of number of distribution) | Particles of 1.0 to 2.5 μm (% in terms of number of distribution) | Particles of 1.0 μm or less (% in terms of number of distribution) | Color of coloring agent #1 | Type of color particles | Pigment concentration C (%) | True specific gravity a | aDC (a × D × C) | Pigment dispersed particle diameter (μm)*2 |
|---|---|---|---|---|---|---|---|---|---|---|
| E | 5.7 | 28.4 | 0.0 | 1.8 | C | E | 6 | 1.22 | 41.7 | 0.24 |
| F | 5.8 | 30.6 | 0.0 | 1.7 | C | F | 8 | 1.23 | 57.0 | 0.24 |

*1 Types of colors . . . K: black, M: magenta, C: cyan, Y: yellow

*2 Pigment dispersed particle diameter . . . Dispersed particle average diameter in a binder resin of pigment fine particles (corresponding circle diameter: μm)

To the color particles were added silica ($SiO_2$) fine particles subjected to surface hydrophobic treatment with hexamethyldisilazane (hereinafter sometimes abbreviated as "MHMDS") and having a primary particle average diameter of 40 nm and metatitanic acid compound fine particles having a primary particle average diameter of 20 nm which are a reaction product of metatitanic acid and isobutyltrimethoxysilane such that the coating rate to the surfaces of the color particles reached 40%. These were mixed with a Henschel mixer to prepare toners A to F (symbols A to F applied to the resulting toners correspond to symbols A to F applied to the color particles used).

The coating rate to the surfaces of the color particles is the value F (%) obtained by formula (1).

Further, the reaction conditions of metatitanic acid and isobutyltrimethoxysilane are as follows. A 4N sodium hydroxide aqueous solution was added to the metatitanic acid slurry to adjust the pH to 9. The mixture was stirred, and then neutralized with 6N hydrochloric acid. This was filtered, and the resulting material obtained on the filter paper was washed with water. Water was added again to the material to form a slurry. 6N hydrochloric acid was added thereto to adjust the pH to 1.2. The mixture was stirred for a fixed period of time, and peptized. Isobutyltrimethoxysilane was added to the peptized slurry, and the mixture was stirred for a fixed period of time. Then, the reaction mixture was neutralized with a 8N sodium hydroxide aqueous solution. This was filtered, and a product obtained on the filter paper was washed with water, dried at 150° C., and pulverized with a jet mill. Thereafter, coarse particles were removed to obtain metatitanic acid fine particles having a primary particle average diameter of 20 nm, a reaction product of metatitanic acid and isobutyltrimethoxysilane.

With respect to the resulting toners A to F, the coating rate of the external additive and the peak value and the bottom value in the frequency distribution of the q/d value in an atmosphere of a temperature of 20° C. and a humidity of 50% are shown in Table 2.

TABLE 2

| Type of a toner | Color | Coating rate (%) of external additive: Superfine articles | Coating rate (%) of external additive: Hyperfine articles | Frequency distribution of q/d value: Peak value | Frequency distribution of q/d value: Bottom value | Remarks |
|---|---|---|---|---|---|---|
| A | C | 40% | 40% | −0.351 | −0.210 | Invention |
| B | M | 40% | 40% | −0.340 | −0.191 | Invention |
| C | Y | 40% | 40% | −0.450 | −0.263 | Invention |
| D | K | 40% | 40% | −0.370 | −0.195 | Invention |

TABLE 2-continued

| Type of a toner | Color | Coating rate (%) of external additive: Superfine articles | Coating rate (%) of external additive: Hyperfine articles | Frequency distribution of q/d value: Peak value | Frequency distribution of q/d value: Bottom value | Remarks |
|---|---|---|---|---|---|---|
| E | C | 25% | 30% | −0.631 | −0.291 | Comparative Example |
| F | C | 25% | 30% | −0.643 | −0.251 | Comparative Example |

*1 Types of colors . . . K: black, M: magenta, C: cyan, Y: yellow

<Carrier Production Example>

A fluoroethyl methacrylate/methyl methacrylate copolymer (copolymerization ratio 70:30, 2.5 parts by weight), 0.5 parts by weight of carbon black and 0.3 parts by weight of melamine fine particles (particle diameter 0.3 μm) were dissolved and dispersed in 25 parts by weight of toluene to prepare a coating solution. One hundred parts by weight of ferrite particles (average particle diameter 35 μm) were charged into this coating solution, and the mixture was stirred at 80° C. for 30 minutes using a vacuum deaeration-type kneader. Subsequently, toluene was distilled out under reduced pressure to produce a carrier having a volume average particle diameter of 35 μm.

<Developer Production Example>

One hundred parts of the carrier obtained in Carrier Production Example and 4 parts by weight of each of the toners A to F obtained in Toner Production Examples. Thus, developers A to F were obtained (symbols A to F applied to the resulting developers correspond to symbols A to F of the toners used).

<Production of latent image supports>

[Latent image support A>

A solution comprising 10 parts by weight of a zirconium compound ("Organotix ZC540", supplied by Matsumoto Seiyaku), 1 part by weight of a silane compound ("A1110", supplied by Nippon Unicar), 40 parts by weight of isopropanol and 20 parts by weight of butanol was coated on an aluminum pipe by a dip coating method, and heat-dried at 150° C. for 10 minutes to form an undercoat layer having a film thickness of 0.1 μm.

Subsequently, 1 part by weight of X-type metal phthalocyanine crystals and 1 part by weight of polyvinyl butyral ("Esleck BM-S", supplied by Sekisui Kagaku) were mixed with 100 parts by weight of cyclohexane, and dispersed along with glass beads for 1 hour using a sand mill. The resulting dispersion was dip-coated on the undercoat layer, and heated at 100° C. for 10 minutes to form a charge generation layer having a film thickness of approximately 0.15 μm. Then, a coating solution obtained by dissolving 2 parts by weight of a benzidine compound represented by the following formula (a) and 3 parts by weight of a high-molecular compound (viscosity average molecular weight 55,000) represented by the following formula (b) in 20 parts by weight of chlorobenzene was coated on the charge generation layer by the dip coating method, and heated at 110° for 40 minutes to form a charge transfer layer having a film thickness of 20 μm. This is designated a latent image support A.

structural formula (a)

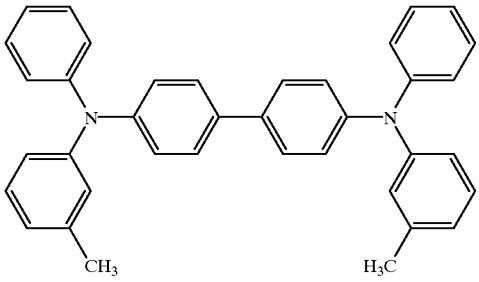

structural formula (b)

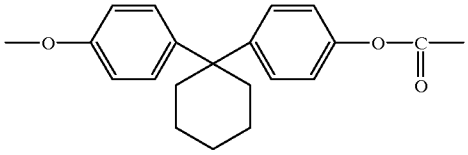

[Latent image support B]

Further, a coating solution obtained by dissolving 1 part by weight of a compound represented by the following structural formula (c) and 2 parts by weight of a solution (solid content 67% by weight) represented by the following structural formula (d) in 50 parts by weight of cyclohexanone was spray-coated on the charge transfer layer of the latent image support A, dried at room temperature for 10 minutes, and heated at 150° C. for 60 minutes to form a surface coating layer having a film thickness of 4 μm. Thus, a latent image support B was obtained.

structural formula (c)

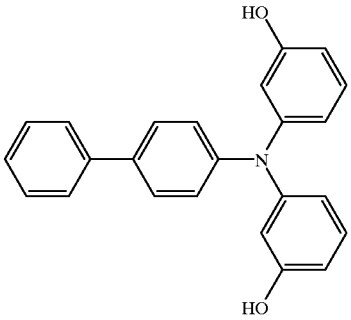

structural formula (d)

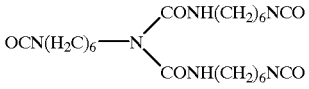

EXAMPLE 1

The above-obtained latent image support A was put into remodeled Acolor 935 (remodeled such that a voltage can be adjusted in the development from an external power source), and the developer A (cyan) was further filled therein to conduct a copying test. In this copying test, a solid image with an image area rate of 100% was formed on the surface of the latent image support A, and the development parameter was adjusted such that the amount (DMA) of the toner of the toner image reached the value shown in Table 3. Further, in the subsequent copying test, the transfer parameter was appropriately adjusted.

The contents and the results of the evaluation test in the copying test will be described later. Incidentally, DMA was measured as follows.

<Amount (DMA) of the toner of the toner image formed on the latent image support>

The solid image with the image area rate of 100% was formed on the latent image support, and the amount (DMA: $mg/cm^2$), per unit area, of the image portion was measured. Specifically, the unfixed solid image in the area of 10 $cm^2$ was formed on the latent image support. A mending tape weighed was adhered to the toner image formed on the latent image support, and then peeled off therefrom to move the toner onto the mending tape. This procedure was repeated until the toner of the toner image formed disappeared. The total amount of the toner moved onto the mending tape was defined as DMA.

The DMA image density in the solid image with the image area rate of 100% was measured as follows.

EXAMPLE 2

The copying test was conducted in the same manner as in Example 1 except that the developer B (magenta) was filled and the development parameter was appropriately adjusted such that DMA in the solid image with the image area rate of 100% became the value shown in Table 3. The contents and the results of the evaluation test in the copying test will be described later.

EXAMPLE 3

The copying test was conducted in the same manner as in Example 1 except that the developer C (yellow) was filled and the development parameter was appropriately adjusted such that DMA in the solid image with the image area rate of 100% became the value shown in Table 3. The contents and the results of the evaluation test in the copying test will be described later.

EXAMPLE 4

The copying test was conducted in the same manner as in Example 1 except that the developer D (black) was filled and the development parameter was appropriately adjusted such that DMA in the solid image with the image area rate of 100% became the value shown in Table 3. The contents and the results of the evaluation test in the copying test will be described later.

EXAMPLE 5

The copying test was conducted in the same manner as in Example 1 except that the above-obtained latent image support B was used. The contents and the results of the evaluation test in the copying test will be described later.

COMPARATIVE EXAMPLE 1

The copying test was conducted in the same manner as in Example 1 except that the developer E (cyan) was filled and the development parameter was appropriately adjusted such that DMA in the solid image with the image area rate of 100% became the value shown in Table 3. The contents and the results of the evaluation test in the copying test will be described later.

COMPARATIVE EXAMPLE 2

The copying test was conducted in the same manner as in Example 1 except that the developer F (cyan) was filled and the development parameter was appropriately adjusted such that DMA in the solid image with the image area rate of 100% became the value shown in Table 3. The contents and the results of the evaluation test in the copying test will be described later.

DMA in the solid image with the image area rate of 100% in each of Examples 1 to 5 and Comparative Example 1 and 2 is shown in Table 3. Further, the amount (TMA) of the toner with the image area rate of 100% of the toner image transferred onto the transfer material is also shown therein. Incidentally, TMA was measured as follows.

<Amount (TMA) of the toner of the toner image transferred onto the transfer material>

The solid image with the image area rate of 100% was formed on the transfer material, and the amount (TMA: $mg/cm^2$) of the toner per unit area of the image portion was measured. Specifically, an unfixed solid image in an area of 10 $cm^2$ was formed on the transfer material, and the weight thereof was measured. Then, the unfixed toner on the transfer material was removed using an air blower. Thereafter, the weight of the transfer material alone was measured, and TMA was calculated from the difference between the weight before removal of the unfixed toner and the weight after removal of the unfixed toner.

TABLE 3

| | DMA $mg/cm^2$ | TMA $mg/cm^2$ |
|---|---|---|
| Examples 1 and 5 | 0.28 | 0.25 |
| Example 2 | 028 | 0.25 |
| Example 3 | 0.30 | 0.28 |
| Example 4 | 0.29 | 0.26 |
| Comparative Example 1 | 0.59 | 0.50 |
| Comparative Example 2 | 0.53 | 0.45 |

[Contents and results of the evaluation test]

The contents of the evaluation test in the copying tests in Examples 1 to 5 and Comparative Examples 1 and 2 are as follows.

<Image density>

With respect to the solid image portion with the image area rate of 100%, the image density of the image portion was measured using X-Rite 404 (supplied by X-Rite).

<Test for observation of the toner image on the latent image support>

An image of a fine line having a line width of 50 $\mu$m was formed on the latent image support, and the disorder of the edge of the fine line was directly observed with a magnification of 500× using VH-6200 Micro-Hi-Scope (supplied by Kience). The specific evaluation standard was as follows.

○: The disorder of the edge of the fine line is not observed.

Δ: The disorder of the edge of the fine line is slightly observed.

X: The disorder of the edge of the fine line is notably observed.

<Test for observation of the transfer image on the transfer material>

An image of a fine line having a line width of 50 $\mu$m was formed on the latent image support, and transferred onto a transfer material. With respect to the transferred image (unfixed) of the fine line on the transfer material, the disorder of the edge of the fine line was directly observed with a magnification of 500× using VH-6200 Micro-Hi-Scope (supplied by Kience). The specific evaluation standard was as follows.

○: The disorder of the edge of the fine line is not observed.

Δ: The disorder of the edge of the fine line is slightly observed.

X: The disorder of the edge of the fine line is notably observed.

<Test for evaluation of fine line reproducibility>

An image of a fine line having a line width of 50 $\mu$m was formed on the latent image support, transferred onto a transfer material, and fixed thereon. The image of the fine line of the fixed image on the transfer material was observed with a magnification of 500× using VH-6200 Micro-Hi-Scope (supplied by Kience). The specific evaluation standard was as follows.

○: The disorder of the edge of the fine line is not observed.

Δ: The disorder of the edge of the fine line is slightly observed.

X: The disorder of the edge of the fine line is notably observed.

<Test for evaluation of gradation reproducibility>

The density of the gradation image in the input and the density of the gradation image formed (output) on the transfer material were measured, and the change in the gradation was evaluated. The image density was measured using X-Rite 404 (supplied by X-Rite). The specific evaluation standard was as follows.

○: The gradation reproducibility was equal to or higher than that of a printed product obtained by 175 line offset printing.

Δ: The gradation reproducibility is slightly inferior to that of a printed product obtained by 175 line offset printing.

X: The gradation reproducibility is much inferior to that of a printed product obtained by 175 line offset printing.

<Test for evaluation of a uniformity of a solid image>

A difference in the image gloss between the surface of the transfer material and the image region having the image density of 1.2 or more and a difference in the image gloss between the image region of the primary color having the image density of 1.2 or more and the image density of the tertiary color having the image density of 1.2 or more were organoleptically evaluated. The specific evaluation standard is as follows.

○: The uniformity is equal to or higher than that of a printed product obtained by 175 line offset printing.

Δ: The uniformity is slightly inferior to that of a printed product obtained by 175 line offset printing.

X: The uniformity is much inferior to that of a printed product obtained by 175 line offset printing.

<Test for evaluation of a wear rate of an organic photoconductive layer of a latent image support>

The copying test was continuously conducted. The thickness of the organic photoconductive layer of the latent image support in printing approximately 50,000 sheets was measured to evaluate the wear rate of the organic photoconductive layer. The specific evaluation standard is as follows.

◎: The wear rate of the organic photoconductive layer of the latent image support was less than 3%.

○: The wear rate of the organic photoconductive layer of the latent image support was between 3 and 5%.

Δ: The wear rate of the organic photoconductive layer of the latent image support was between 5 and 10%.

<Test for evaluation of a defect of an image by adhesion of an external additive to a latent image support>

The copying test was continuously conducted until 30,000 sheets were printed, and the defect of the image deemed to occur owing to the adhesion of the external additive to the latent image support was visually evaluated. The specific evaluation standard is as follows.

○: The defect of the image owing to the adhesion of the external additive to the latent image support does not occur until 30,000 sheets are printed.

Δ: The defect of the image owing to the adhesion of the external additive to the latent image support does not occur until 20,000 sheets are printed, but occurs before 30,000 sheets are printed.

X: The defect of the image owing to the adhesion of the external additive to the latent image support occurs before 20,000 sheets are printed.

The evaluation results in the copying test in Examples 1 to 5 and Comparative Example 1 and 2 are shown in Table 4.

TABLE 4

| | Image density | Observation of a toner image on a latent image support | Observation of a transfer image on a transfer material | Fine line reproducibility | Gradation reproducibility | Uniformity of a solid image | Rate of wear of an organic photoconductive layer of a latent image support | Defect of an image owing to adhesion of an external additive to a latent image support |
|---|---|---|---|---|---|---|---|---|
| Example 1 | 1.8 | ○ | ○ | ○ | ○ | ○ | ○ | ○ |
| Example 2 | 1.8 | ○ | ○ | ○ | ○ | ○ | ○ | ○ |
| Example 3 | 1.7 | ○ | ○ | ○ | ○ | ○ | ○ | ○ |
| Example 4 | 1.8 | ○ | ○ | ○ | ○ | ○ | ○ | ○ |
| Example 5 | 1.8 | ○ | ○ | ○ | ○ | ○ | ⊙ | ○ |
| Comparative Example 1 | 1.8 | Δ | Δ | Δ | Δ | Δ | Δ | Δ |
| Comparative Example 2 | 1.8 | Δ | Δ | Δ | Δ | Δ | Δ | Δ |

EXAMPLE 6

The above-obtained latent image support A was put into remodeled Acolor 935 (remodeled such that a voltage can be adjusted in the development with an external power source) supplied by Fuji Xerox. Further, the cyan, magenta, yellow and black developers A to D produced in Developer Production Examples were filled therein. Thus, the copying test of a full color was conducted. The evaluation test was conducted as in Examples 1 to 5 and Comparative Examples 1 and 2 (the image density was an image density of process black with an image area rate of 100% obtained by laminating toners of cyan, magenta and yellow). In the copying test, the development parameter was appropriately adjusted such that the developers A to D had the corresponding DMA values in the solid image with the image area rate of 100% as shown in Examples 1 to 4. The results are shown in Table 5.

EXAMPLE 7

The copying test of the full color was conducted in the same manner as in Example 6 except that the above-obtained latent image support B was used. The results are shown in Table 5.

TABLE 5

| | Image density | Observation of a toner image on a latent image support | Observation of a transfer image on a transfer material | Fine line reproducibility | Gradation reproducibility | Uniformity of a solid image | Rate of wear of an organic photoconductive layer of a latent image support | Defect of an image owing to adhesion of an external additive to a latent image support |
|---|---|---|---|---|---|---|---|---|
| Example 6 | 1.8 | ○ | ○ | ○ | ○ | ○ | ○ | ○ |
| Example 7 | 1.8 | ○ | ○ | ○ | ○ | ○ | ⊙ | ○ |

What is claimed is:

1. An image forming method comprising at least a latent image-forming step of forming an electrostatic latent image on a latent image support, a developer layer-forming step of forming a developer layer comprising a toner and a carrier on a surface of a developer support disposed opposite the latent image support, a developing step of developing the electrostatic latent image on the latent image support with the toner in the developer layer to form a toner image, and a transferring step of transferring the toner image developed onto a transfer material, characterized in that the latent image support is obtained by forming at least an organic photoconductive layer on a surface of an electroconductive support, the toner is composed of color particles containing at least a binder resin and a pigment particle, the color particles having a volume average particle diameter between 2.0 and 5.0 μm, the ratio of the color particles of 1.0 μm or less is 20% or less in terms of the number of distribution, and the ratio of the color particles exceeding 5.0 μm is 10% or less in terms of the number of distribution.

2. The image forming method of claim 1, wherein in the toner, ratio of the color particles of from 1.0 to 2.5 μm is between 5.0 and 50% in terms of the number of distribution.

3. The image forming method of claim 1, wherein charge amount of the toner in an atmosphere of a temperature of 20° C. and a humidity of 50% is represented by q(fC) and the particle diameter of the toner is represented by d (μm), the peak value is 1.0 or less and the bottom value is 0.005 or more in the frequency distribution of the q/d value.

4. The image forming method of claims 1, wherein in the developing step, the amount of the toner of the toner image formed on the latent image support is 0.50 mg/cm$^2$ or less.

5. The image forming method of claim 1, wherein the dispersed particle average diameter of the pigment particles in the color particles is 0.3 μm or less in terms of the corresponding circle diameter.

6. The image forming method of claim 1, wherein the toner further contains an external additive.

7. The image forming method of claim 6, wherein the external additive comprises at least one or more types of superfine particles having a primary particle average diameter of at least 30 nm and at most 200 nm and one or more types of hyperfine particles having a primary particle average diameter of at least 5 nm and less than 30 nm, the coating rate of the external additive to the surfaces of the color particles obtained by formula (1)

$$F=\sqrt{3}\cdot D\cdot\rho_t\cdot(2\pi\cdot d\cdot\rho_a)^{-1}\cdot C\times 100 \quad (1)$$

wherein F represents a coating rate (%), D represents a volume average particle diameter (μm) of color particles, $\rho_t$ represents a true specific gravity of color particles, d represents a primary particle average diameter (μm) of an external additive, $\rho_a$ represents a true specific gravity of an external additive, and C represents a ratio (x/y) of an amount x(g) of an external additive to an amount y(g) of color particles is 20% or more on both of the superfine particles Fa and the hyperfine particles Fb, and the total coating rate of the overall external additive is 100% or less.

8. The image forming method of claim 1, wherein when a pigment concentration of pigment particles in the color particles is represented by C (% by weight), a true specific gravity of the color particles is represented by a (g/cm$^3$) and a volume average particle diameter of the color particles is represented by D (μm), the following relationship (2) is satisfied.

$$25\leqq a\cdot D\cdot C\leqq 90 \quad (2)$$

9. The image forming method of claim 1, wherein the organic photoconductive layer is formed of a charge generation layer composed of at least a charge generation material and a binder resin and a charge transfer layer composed of at least a charge transfer material and a binder resin.

10. The image forming method of claim 9, wherein the binder resin in the charge transfer layer is a polycarbonate resin having a viscosity average molecular weight of from 50,000 to 100,000.

11. The image forming method of claim 9, wherein the weight ratio (s:t) of the charge transfer material s to the binder resin t in the charge transfer layer is between 25:75 and 60:40.

12. The image forming method of claim 1, wherein a surface coating layer is further formed on the surface of the organic photoconductive layer.

13. The image forming method of claim 1, wherein thickness of the organic photoconductive layer is 5 μm or more.

14. The image forming method of claim 1, wherein an undercoat layer is formed on the electroconductive support.

15. The image forming method of claim 13, wherein the thickness of the organic photoconductive layer is 10 μm or more.

16. The image forming method of claim 13, wherein the thickness of the organic photoconductive layer is 2,000 μm or less.

17. The image forming method of claim 9, wherein weight ratio (g:t2) of the charge generation material g to the binder resin t2 in the charge generation layer is between 10:1 and 1:10.

18. The image forming method of claim 12, wherein the surface coating layer is a layer formed by dispersing electroconductive fine particles into a resin.

* * * * *